US006367156B1

(12) United States Patent
Herrmann et al.

(10) Patent No.: US 6,367,156 B1
(45) **Date of Patent: *Apr. 9, 2002**

(54) BLADES FOR HAND HELD POWER OPERATED SHEARS

(75) Inventors: Raymond J. Herrmann, Westlake; Arthur W. Zimmermann, Bay Village, both of OH (US)

(73) Assignee: Bettcher Industries, Inc., Birmingham, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/291,228

(22) Filed: Apr. 13, 1999

Related U.S. Application Data

(60) Continuation of application No. 08/872,754, filed on Jun. 11, 1997, now Pat. No. 5,918,371, which is a continuation of application No. 08/445,344, filed on May 19, 1995, now abandoned, which is a continuation-in-part of application No. 08/330,183, filed on Oct. 27, 1994, now abandoned, which is a division of application No. 08/132,526, filed on Oct. 6, 1993, now Pat. No. 5,375,330.

(51) Int. Cl.[7] ..... B26B 13/04

(52) U.S. Cl. ..... 30/228; 30/249; 30/260; 30/266

(58) Field of Search ..... 30/260, 257, 259, 30/235, 236, 249, 246, 266, 267, 268, 269, 270, 329, 342, 228

(56) References Cited

U.S. PATENT DOCUMENTS

| | | | | |
|---|---|---|---|---|
| 946,414 | A | * | 1/1910 | Wikander |
| 1,943,960 | A | | 1/1934 | Heumann |
| 2,348,612 | A | | 5/1944 | Deacon |
| 2,699,756 | A | | 1/1955 | Miller |
| 2,743,707 | A | | 5/1956 | Kellersman |
| 2,758,372 | A | | 8/1956 | Gammons |
| 2,818,643 | A | | 1/1958 | Dawson |
| 2,939,213 | A | | 6/1960 | Daniel |
| 2,944,340 | A | | 7/1960 | Vosbikian et al. |
| 3,453,730 | A | | 7/1969 | Schmidt |

(List continued on next page.)

FOREIGN PATENT DOCUMENTS

| | | |
|---|---|---|
| DE | A1107556 | 5/1961 |
| DE | 3322912 | 6/1983 |
| GB | 233981 | 5/1925 |
| WO | 9114545 | 10/1991 |

OTHER PUBLICATIONS

European Search Report dated Jul. 25, 1995 for European Application No. EP 94 115291.0, which corresponds to related application (Ser. No. 08/132,526, now U.S. Patent No. 5,375,330).

PCT Search Report dated Aug. 14, 1996 for PCT Application No. PCT/US96/06789, which corresponds to the grandparent application Ser. No. 08/445,344 of the present application.

*Primary Examiner*—Kenneth E. Peterson
(74) *Attorney, Agent, or Firm*—Watts, Hoffmann, Fisher & Heinke, Co., L.P.A.

(57) ABSTRACT

A hand-held power-operated blade-actuating or other work member actuating device, especially useful as shears for processing comestible products such as fowl. A servo mechanism and linkage connected with a movable blade and a finger control causes controlled powered movement of the blade in coordination with the finger control. A fixed blade and a pivoted blade are insertable and removable as a unit from a hand-held frame in which the fixed blade is restrained against rotation relative to the frame. The blades and frame are constructed so the blades are insertable or removable only when closed. In a preferred embodiment the fixed blade is retained in part by two load bearing pins extending from the frame and located substantially diametrically opposite each other relative to the pivot axis of the movable blade.

14 Claims, 20 Drawing Sheets

U.S. PATENT DOCUMENTS

| | | | | |
|---|---|---|---|---|
| 3,688,402 | A | | 9/1972 | Shannon |
| 3,787,742 | A | | 1/1974 | Murphy |
| 3,831,277 | A | | 8/1974 | Nagata |
| 3,834,020 | A | | 9/1974 | Caire |
| 3,970,110 | A | | 7/1976 | Schaedler et al. |
| 4,074,430 | A | | 2/1978 | Sugiyama |
| 4,109,381 | A | | 8/1978 | Pellenc |
| 4,206,603 | A | | 6/1980 | Mekler |
| 4,359,821 | A | | 11/1982 | Pellenc |
| 4,382,331 | A | | 5/1983 | Kimura |
| 4,521,963 | A | | 6/1985 | Lind et al. |
| 4,587,732 | A | | 5/1986 | Lind et al. |
| 4,637,288 | A | | 1/1987 | Olsen et al. |
| 4,756,220 | A | | 7/1988 | Olsen et al. |
| 4,791,726 | A | | 12/1988 | Ailey, Jr. |
| 4,949,461 | A | | 8/1990 | van der Merwe et al. |
| 4,967,474 | A | | 11/1990 | Wells |
| 5,002,135 | A | | 3/1991 | Pellenc |
| 5,150,523 | A | | 9/1992 | McCurry |
| 5,172,479 | A | | 12/1992 | Keeton |
| 5,263,513 | A | | 11/1993 | Roe |
| 5,517,762 | A | | 5/1996 | Kuribayashi |
| 5,918,371 | A | * | 7/1999 | Harrmann et al. |

* cited by examiner

E2
22
244
42
B
E1
256
242
246
252
249
248
254
250
247
150B
284
288

44
282
12
24
286
280
150
290

150A
290A
287A 150
292
294
287

24A
294A
290A
287A
150A
292A
289A 294
290
287

BLADES FOR HAND HELD POWER OPERATED SHEARS

CROSS REFERENCE TO RELATED APPLICATIONS

This is a continuation of copending application Ser. No. 08/872,754 filed Jun. 11, 1997, now issued as U.S. Pat. No. 5,918,371 which is a continuation of Ser, No. 08/445,344 filed May 19, 1995, now abandoned which is a continuation-in-part application of application Ser. No. 08/330,183 filed Oct. 27, 1994, now abandoned which is a divisional application of application Ser. No. 08/132,526 filed Oct. 6, 1993, now issued as U.S. Pat. No. 5,375,330.

BACKGROUND OF THE INVENTION

1. Technical Field

The present invention relates generally to improved power operated shears that are useful for industrial cutting applications. In particular, the improved shears of the present invention are suitable for use in the food processing industry to cut and trim meat, and especially to cut poultry.

2. Description of the Prior Art

Hand held manually operated conventional scissors have been used for cutting and trimming meat and other food products. Conventional scissors also have been used in a variety of other industries for cutting sheet material, such as cloth, textiles or thin metals. It was necessary for an operator of the conventional scissors to use a relatively large cutting effort and often the operator's wrist was at an unnatural orientation. Repetitive use at such orientation and large cutting effort could cause injury to the operator's wrist. To reduce the effort needed to operate such conventional scissors, power operated shears have been devised.

Most known power operated hand held shears have various shortcomings. For example, most such shears do not have a similar physical arrangement to conventional scissors, the blade movement cannot be controlled to the same extent and in the same way as conventional manually powered shears, the blades are not easily replaced and the blades, if replaceable, are not reliably retained in the shears to withstand repeated heavy loading.

Thus, a need exists for power operated or power assisted cutting shears that are arranged, operated and controlled in a manner similar to that of conventional manually-operated scissors, and have easily replaceable blades that can withstand the repeated heavy loading that power operated shears used in a commercial setting will encounter.

SUMMARY OF THE INVENTION

The present invention is directed to replaceable blades for hand held power operated shears used in a commercial setting. The power operated shears overcome the shortcomings of the known power operated shears mentioned above and others by being closely similar in physical arrangement and operation to that of conventional manually operated scissors. Other operating advantages of the hand held power operated shears of the present invention include a controllable rate of closing of blades, a controllable extent of closing, easily replaceable blades and a reliable load bearing mounting for one of the blades.

The present invention is also directed to hand held power operated tools, and more particularly shears. While the invention will be described in connection with the preferred shears, it will be understood that other work members for accomplishing a desired task can be arranged and operated by a tool in the same or similar manner as the shear blades.

The shears include first and second blades for cutting a workpiece upon relative pivotal movement from a first open position towards a second closed position. A frame supports the blades for relative pivotal movement about an axis. A first handle and a second relatively pivotable handle are provided. One of the handles is supported for pivoting about an axis independently of the blades. The pivoting handle extends in a direction relative to the axis opposite the second blade. The other of the handles extends in a direction opposite the first blade relative to the axis. An actuator pivots the second blade relative to the first blade to impart a cutting action between blades. A servo mechanism is controlled by movement of the second blade and pivoting handle to control operation of the actuator to pivot the second blade relative to the first blade in coordination with movement of the pivoting handle.

The blades are readily replaceable. The blades are supported for relative pivotal movement. One blade is constructed to be fixed in a supporting frame. The other blade is constructed to be pivotable relative to the frame and first blade. The pivotable blade has an actuating portion extending in an opposite direction from the pivot from a cutting portion of the blade at an obtuse angle in the range of about 120° to 170° relative to a portion of the cutting edge.

The actuating portion of the pivotable blade has a drive slot that receives a portion of a drive link connected to a piston rod of the fluid actuator. The length and angle of the actuating portion of the pivotable blade and the distance the slot length extends, as well as the location of the pivot, are coordinated with the drive link to allow a size and arrangement of the parts that facilitate locating parts in the area of the shears that can be accommodated by the palm of the operator's hand. The length and angle of the actuating portion at the same time produces relatively high leverage between the blade and the fluid actuator over a cutting excursion of 45 degrees of relative pivoting of the blades. The provision of relatively high leverage assures lower reaction forces at the pivot of the blades. Lower reaction forces allow lower structural weight and longer wear life. Relatively high leverage also allows the use of a relatively slim actuating cylinder that can provide adequate force using typical shop air pressures.

The pivotable blade has a heel portion forming a part of the actuating portion. The heel portion has a ride surface facing an opposed surface of the fixed blade. In one embodiment a part of the opposed surface of the fixed blade projects toward the ride surface of the pivotable blade, biasing the cutting edges of the blades into mutual contact where the cutting edges intersect.

Thus, the invention herein disclosed and claimed is, in its principal broad aspects, directed to a pair of replaceable blades for a hand-held power-operated blade-actuating device. The blades are without handles, have cooperating edges for cutting, and the pair comprises a first blade having a cutting portion and having a mounting portion by which the first blade can be fixed relative to a support and a second blade having a cutting portion and an actuating portion and constructed to be pivoted relative to the support and the first blade at a location on the second blade between the cutting portion of the second blade and the actuating portion of the second blade. A surface forms a part of the actuating portion for operatively coupling the second blade to a power actuator. The actuating portion of the second blade includes a portion that is located relative to the mounting portion of the first blade and the support structure when the blades are closed to allow attachment and removal of the blades as an assembled unit to or from the support, and is located when the blades are open to prevent the attachment or removal of the blades to or from the support. A locating surface on the pair of assembled blades extends transversely of the general extent of the blades for engaging with a surface of the support that extends transversely of the general extent of the blades when the blades are mounted on the support.

The portion of the second blade that allows or prevents attachment or removal of the blades in one preferred embodiment is constructed to underlie the mounting portion of the first blade when the blades are closed and to extend from behind the mounting portion when the blades are not closed, and when extending is obstructed by a surface of the support from moving in a direction along which the blades can be removed from the support.

In one preferred embodiment a locating surface of the assembled blades is at the pivot between the blades. In another preferred embodiment, a locating surface is provided on a mounting portion of one of the blades, and in its preferred construction, two apertures are provided, located to lie on substantially diametrically opposite sides of the pivot for the blades.

The invention, in its broad aspects applies to work members other than shears or replaceable cutting blades, but otherwise of the general description as above.

Further features of the present invention will become apparent to those skilled in the art to which the present invention relates from reading the following descriptions with reference to the accompanying drawings.

DETAILED DESCRIPTION OF A PREFERRED EMBODIMENT

Overview

Figure 1:
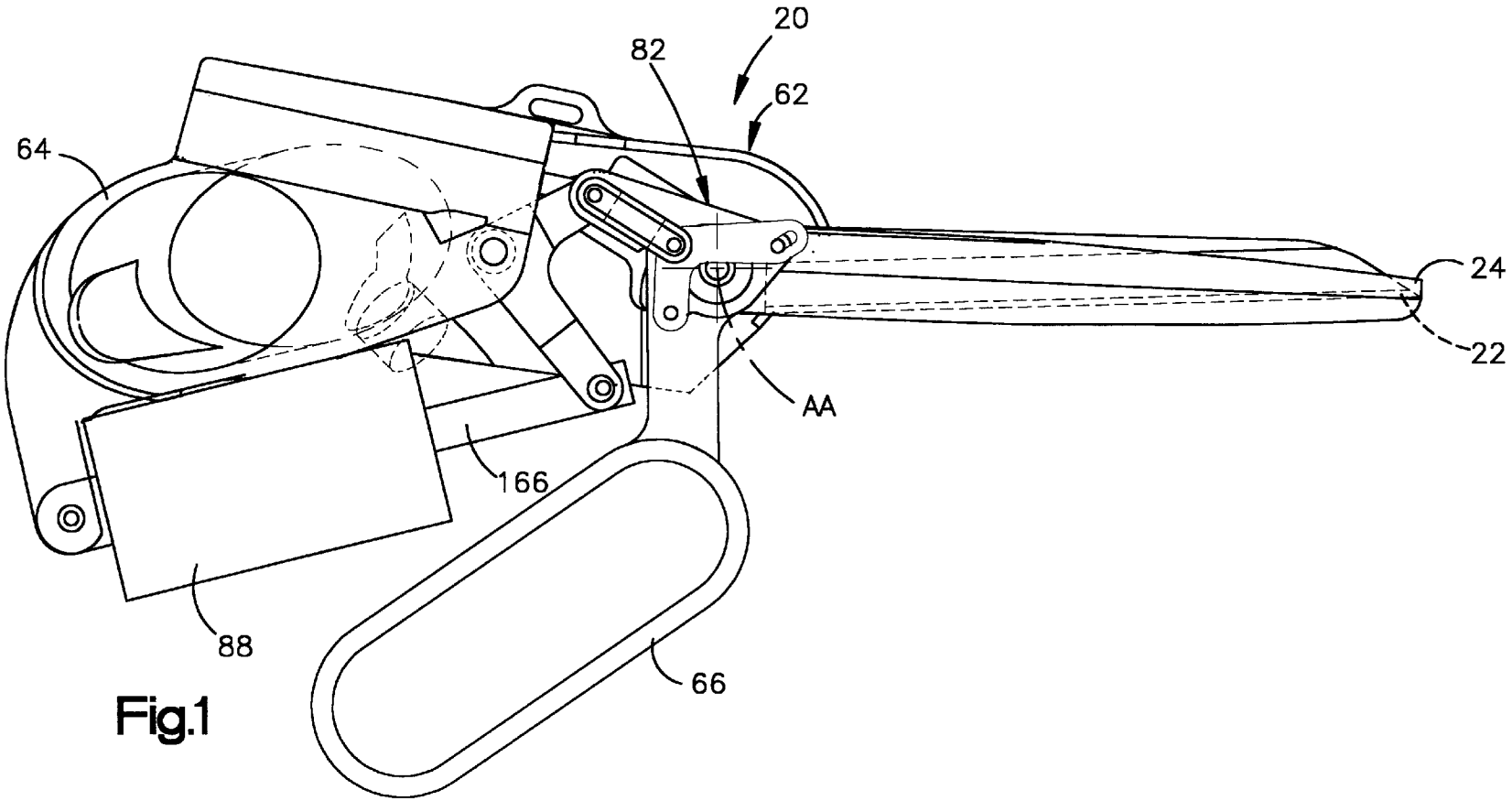
FIG. 1 is a plan view of hand held power operated shears embodying the present invention with the handles and blades in fully closed relative positions.

Hand held power operated shears 20, embodying the present invention, are illustrated in FIG. 1. The shears 20 include a pivotable blade 22 which is reciprocable relative to another blade 24 between the fully open position illustrated in FIG. 2 and the fully closed position illustrated in FIG. 1. A cutting or shearing action is provided between the cutting edges 42, 44 (FIG. 2) of the blades 22, 24, respectively, during movement of the pivotable blade 22 relative to the blade 24 from the open position towards the closed position. An advantage of the present invention is that the shears 20 appear, and operate in a manner, very similar to conventional manually powered scissors. This conventional type of operation is advantageous because little or no training or adaptation to the power operated shears 20 is required.

The blades 22, 24 are supported in a frame 62 about an axis AA. The frame 62 supports the blade 24 in a fixed relative position. The blade 22 is pivotable relative to the frame 62 and relative to the fixed blade 24 about the axis AA. A thumb handle portion 64 is formed in the frame 62 for receiving an operator's thumb to support and control the shears 20. A finger loop handle 66 is supported in the frame 62 for pivotal movement. Thus, the blades 22, 24 and the finger loop handle 66 are all supported on the frame 62 along the axis AA. In response to pivotal movement of the handle 66 relative to the frame 62 and thumb handle portion 64, the blade 22 is power driven to pivot relative to the blade 24.

The frame 62 also supports a servo mechanism 82 (FIGS. 1–5) for controlling the power applied to pivot the blade 22.

The servo mechanism 82 includes a servo control valve 84 (FIG. 3), an optional safety valve 86, an actuator 88, a drive link 102, and a feedback linkage 104. The drive link 102 transmits power from the actuator 88 to the pivotable blade 22. The feedback linkage 104 determines the difference between the position of the finger loop handle 66 relative to the frame 62 and the position of the pivotal blade 22 relative to the frame. The feedback linkage 104 communicates the difference between the position of the blade 22 and the position of the loop handle 66 to the servo control valve 84. The control valve 84 selectively permits or inhibits the flow of a power medium to the actuator 88. The power is preferably provided by a fluid, such as pressurized air. However, it will be apparent that hydraulic or electrical power assist can be used.

Figure 19:
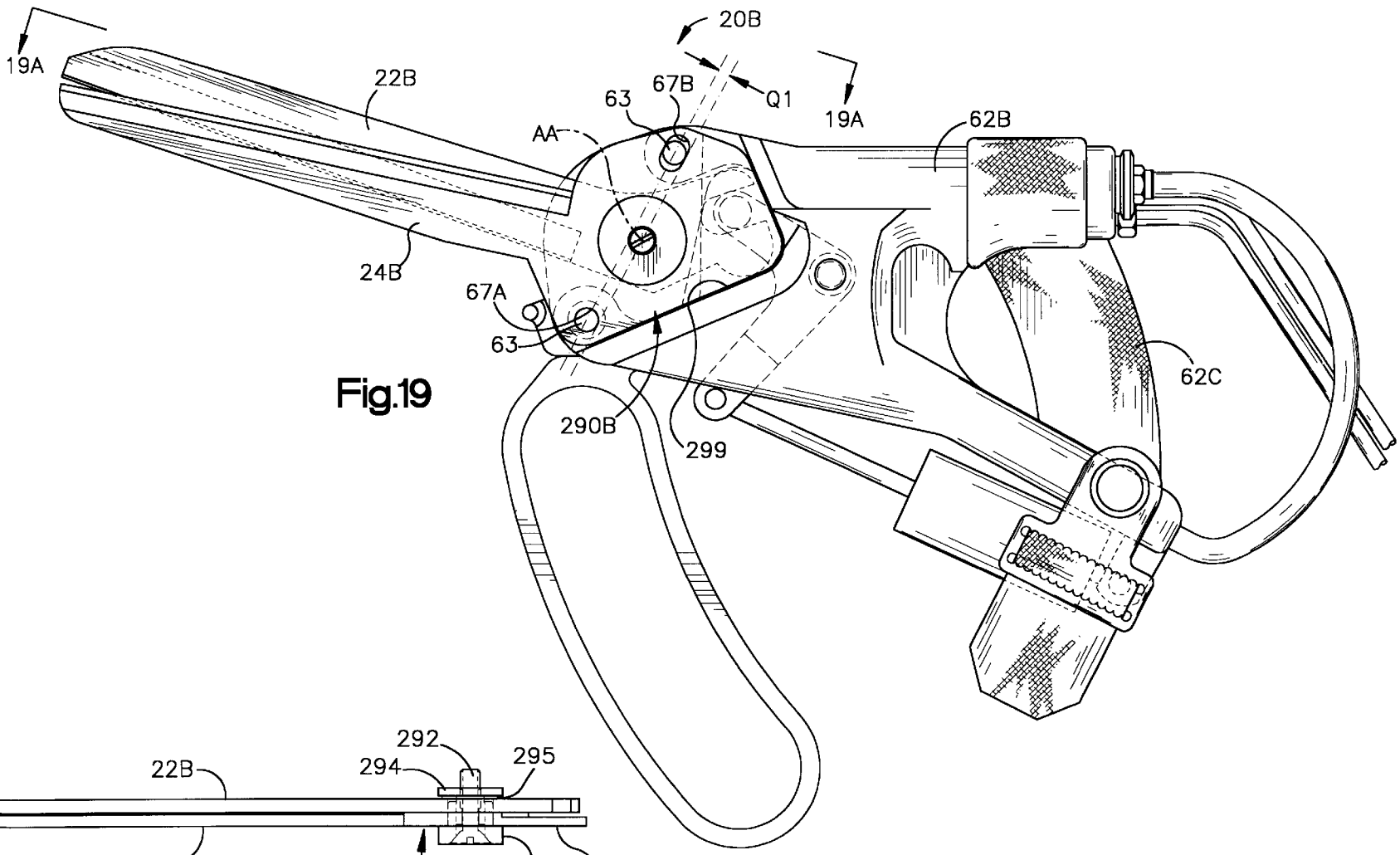
FIG. 19 is an enlarged side elevational view of a frame of an alternate embodiment and replaceable blades of the invention, illustrating a load bearing mounting arrangement between one of the blades and the frame.

Another mounting arrangement between a modified fixed blade 24B and a modified frame 62B is illustrated in FIG. 19. The mounting arrangement between replaceable blades 22B, 24B and the frame 62B is designed to be secure and reliable, yet easily replaceable, when the blades are to be changed. The modified frame 62B includes a pair of load bearing pins 63 fixed to and extending transversely from a portion of the frame 62B. The pins 63 are located on substantially diametrically opposite sides of the axis AA about which the blades relatively pivot. The fixed blade 24B includes a pair of openings 67A, 67B formed in its mounting portion 290B. The load bearing pins 63 are received in the pair of openings and receive the majority of the load between the frame and the blades occurring during relative pivoting of the blades 22B, 24B during a cutting operation.

Construction

The pivotable blade 22 is preferably formed from a suitable metal, such as stainless steel. The cutting edge 42 is formed in the blade 22 by a suitable operation such as by grinding and/or polishing. Preferably, the cutting edge 42 is substantially straight. However, it will be apparent that the cutting edge 42 may be formed into any suitable shape necessary to perform a desired cutting function, for example, a large radius curve or straight portion and a curved tip end portion with a relatively large radius.

Figure 2:
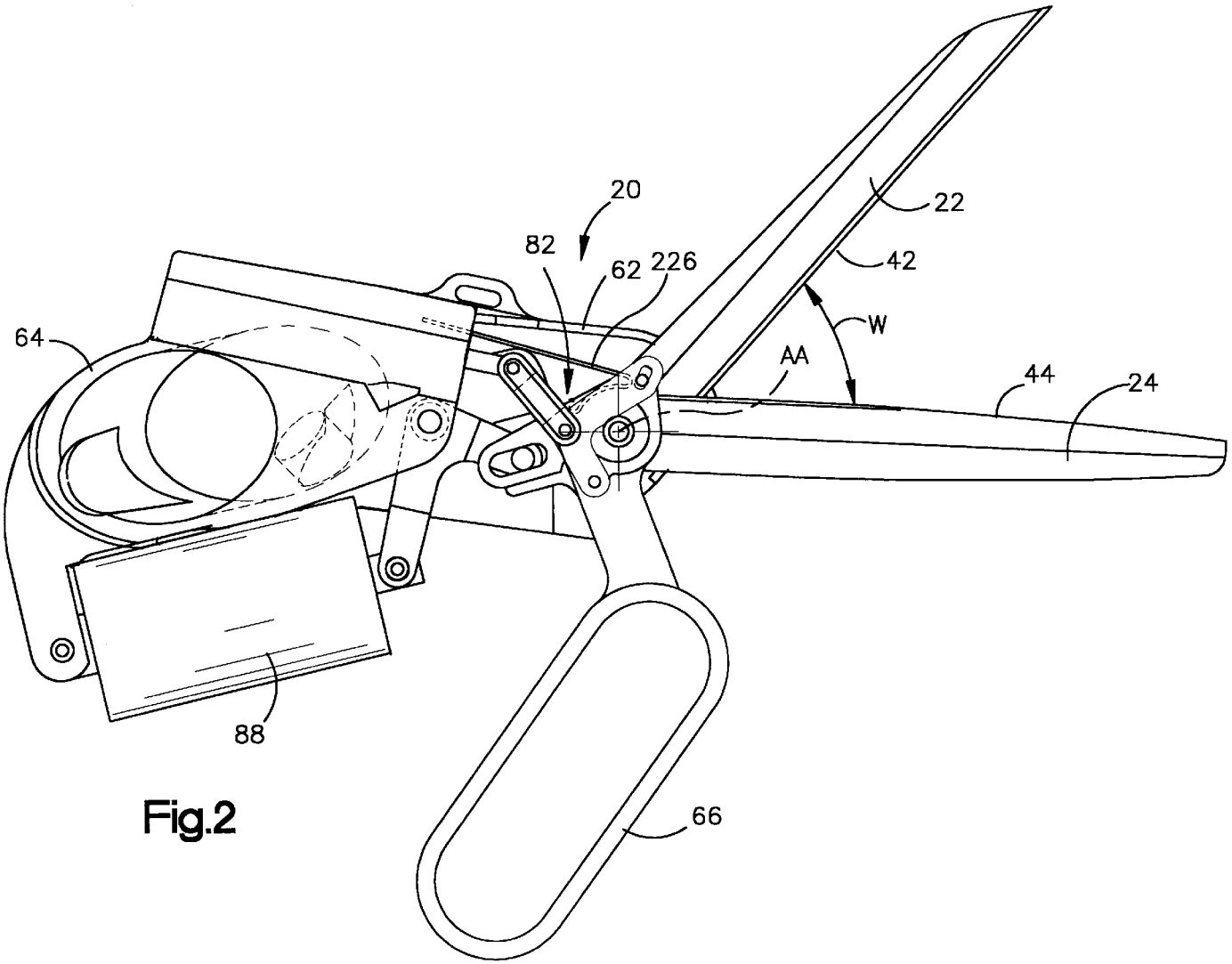
FIG. 2 is a view similar to FIG. 1 with parts in fully open relative positions.
Figure 8:
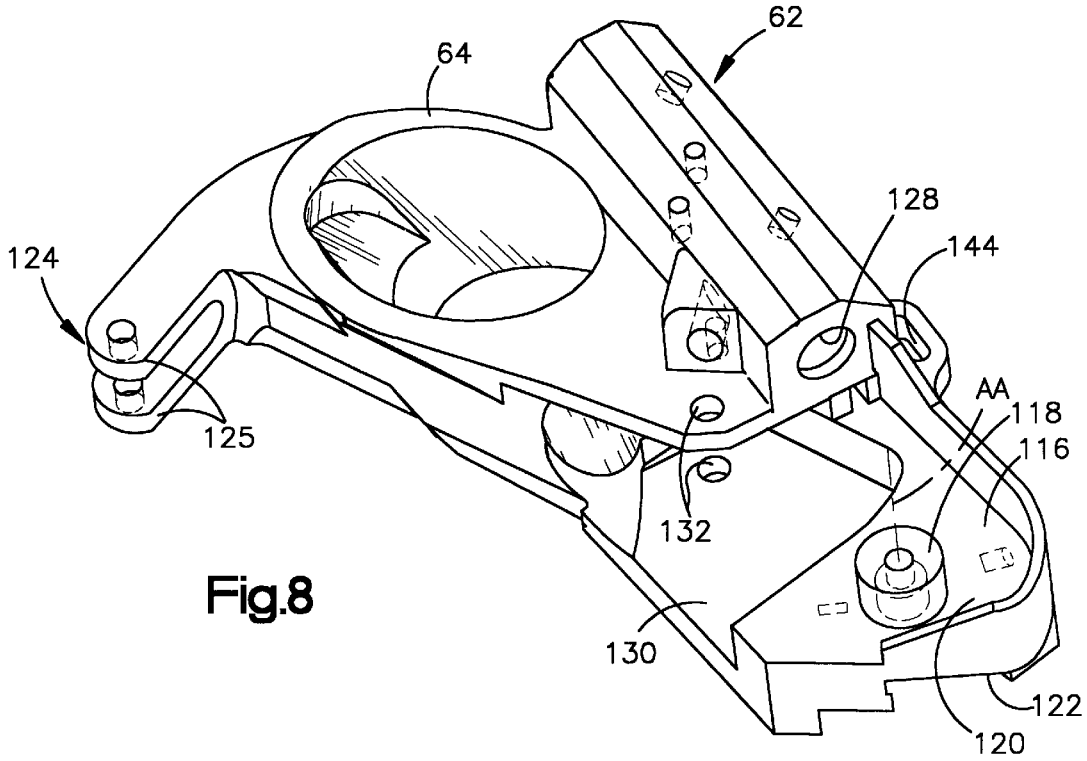
FIG. 8 is an enlarged perspective view of the frame and handle of the shears.
Figure 9:
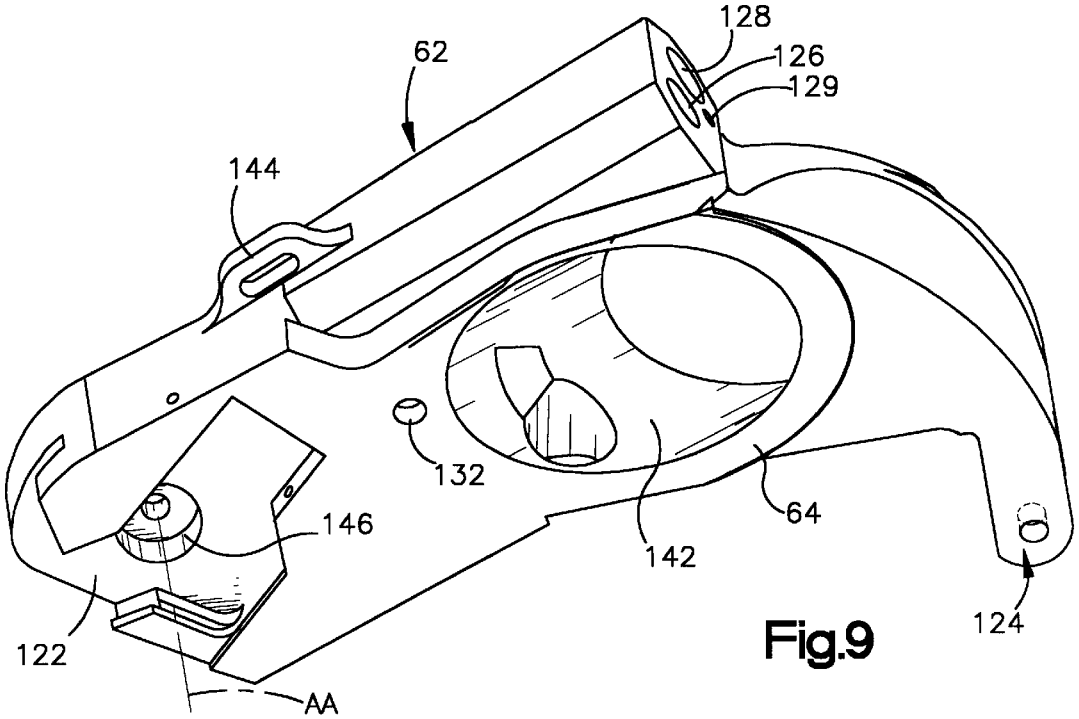
FIG. 9 is an enlarged perspective view of the frame and handle in FIG. 8 viewed from another direction.

The frame 62 (FIGS. 8 and 9) supports all of the parts of the shears 20. The thumb handle portion 64 is integrally formed in the frame 62 for receiving an operator's thumb. The frame 62 also includes a recess 120 (FIG. 8), a recess 122 (FIGS. 6 and 9), exhaust port 129 (FIG. 9), an actuator support 124 (FIGS. 8 and 9), valve chambers 126, 128 (FIG. 9), a thumb opening 142 and an attachment hook 144. The attachment hook 144 permits the frame 62 and shears 20 to be connected during use to a weight compensating device, such as a constant force spring. The recess 120 (FIG. 8) in the frame 62 receives the feedback linkage 104 and a pivot portion of the finger loop handle 66. A support 118 is integrally formed on the frame 62 and projects generally perpendicularly from a side surface 116 defining a portion of the recess 120. The support 118 is received in an opening 119 (FIG. 14) in the pivot portion of the finger loop handle 66 in a close fit relationship for pivotal movement about the axis AA. The uncovered recess 120 allows easy removal of any debris that may enter the recess and contact the feedback linkage 104 or pivot portion of the finger loop handle 66. A return spring 226 (FIG. 14) is located within the recess 120 and engages both the finger loop handle 66 and the frame 62. The return spring 226 continually biases the loop handle 66 towards a fully open position, as illustrated in FIG. 2.

A recess portion 130 (FIG. 8) defines a space which is in communication with the recess 120 and the recess 122 to permit interaction between the blades 22, 24; the finger loop handle 66; the servo mechanism 82 and the feedback linkage 104. The recess portion 130 is located between the recess 120 and thumb handle portion 64. The recess 130 receives the drive link 102 (FIGS. 4 and 5) therein. The drive link 102 is supported for pivotal movement within the recess portion 130 at openings 132 (FIGS. 8 and 9) by a pin 134 (FIG. 14). extending through the opening. The drive link 102 (FIGS. 4 and 5) connects the actuator with the pivotable blade 22. The drive link 102 forces the blade 22 to pivot relative to the frame 62 and relative to the fixed blade 24 in response to movement of the rod 166 (FIG. 14) of a part in the actuator 88.

The recess 122 in the frame 62 receives the blades 22, 24. A cavity 146 (FIGS. 6 and 9) within the recess 122 extends coaxially inside of the support 118 which projects to the recess 120 from the surface 116. The opening 146 receives a support member 148 on which the blades 22, 24 are supported. The blade 22 is closely fit about the support member 148 for pivotal movement about the axis AA. The blade 24 is also closely fit on the support member 148. The blade 24 is fixed relative to the frame 62 by a surface 150 of the blade that engages surfaces 152, 154 of the recess 122, which prevents movement of the blade relative to the frame 62. The surfaces 152, 154 in the recess 122 are located on diametrically opposite sides of the blade 24 relative to the axis AA to engage the surfaces 150 and 150B of a mounting portion 290 (FIG. 11) of the fixed blade 24 in connection with the support member 148 to accommodate reaction forces acting on the blade 24. The blades 22, 24 are illustrated in the fully open position in FIGS. 2 and 7. The pivotable blade 22 is disposed at an acute angle W of about 40° to 45° relative to the fixed blade 24. This angle W, however, can be predetermined and varied for specific job requirements, such as by using a different servo mechanism 82, blade 22 or frame 62.

The recess 122 is closed by a latch cover plate 162 (FIGS. 6 and 7), after the blades 22, 24 are received therein. The frame 62 and latch cover plate 162 protect the blades 22, 24 from debris entering the recess 122. The latch cover plate 162 includes a body portion 160 for closing the recess 122 and for preventing the blades 22, 24 and support member 148 from movement laterally outwardly of the recess in a direction along the axis AA.

Figure 7:
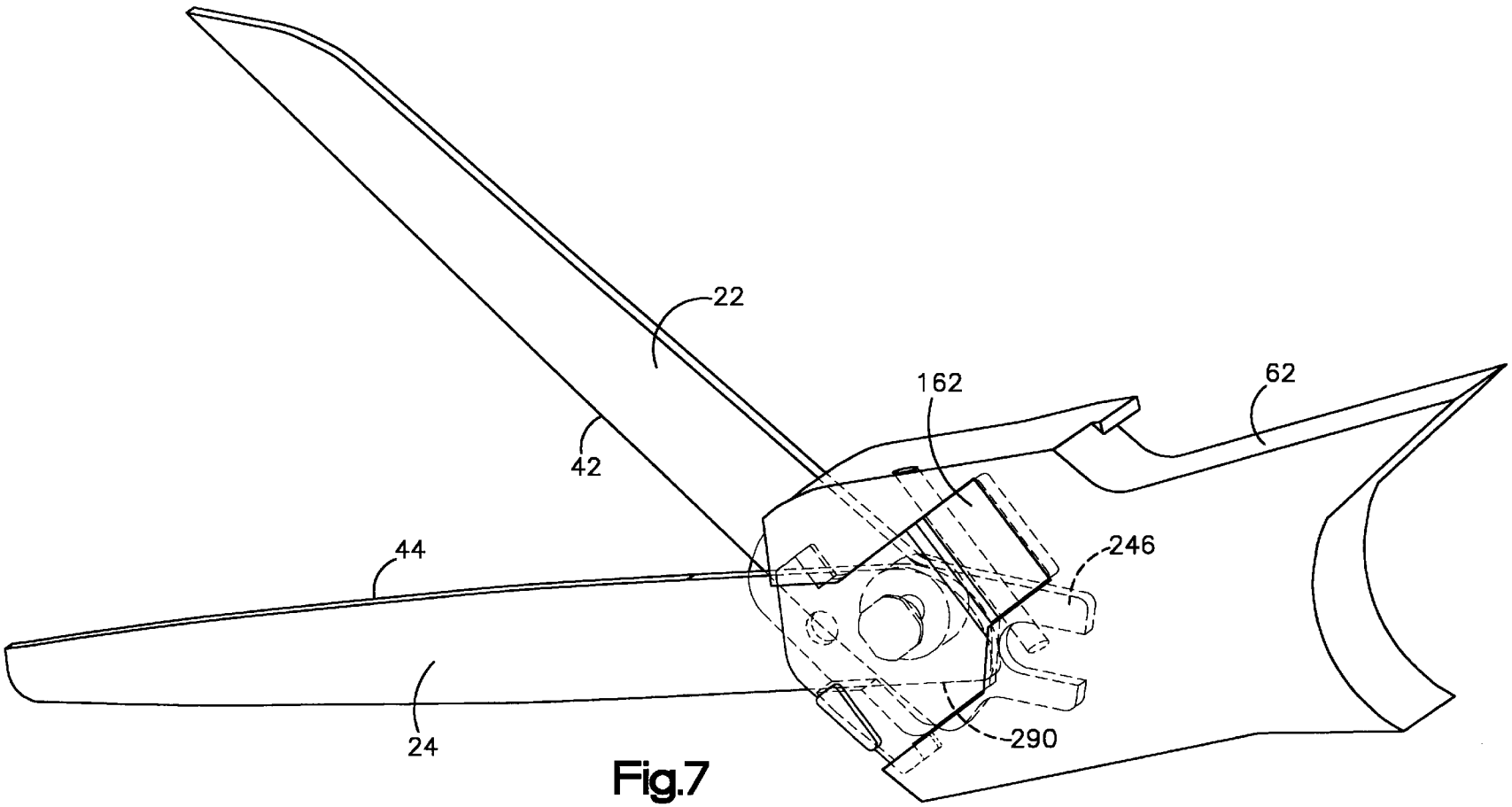
FIG. 7 is a perspective view of the portion of the shears in FIG. 6 with the parts assembled.

It will be clear from FIG. 7 that, by virtue of the shape of the opening in which the cover 162 fits and through which the mounting portion 290 and actuating portion 246 must fit to be installed or removed, the blades must be closed during installation or removal to align the actuating portion with the opening. This provides a safety feature to reduce risk of an operator being cut by the sharp edges during handling or by having the blades in an unsafe condition at the time they are installed and connected to the actuating mechanism.

The latch cover plate 162 is movable relative to the frame 62 in the directions indicated by arrows 159 (FIG. 6) formed on the exterior of the latch cover plate to permit access to the blades 22, 24. A connecting portion 157 extends from the body portion 160 to pivotally and slidably attach the latch cover plate 162 to the frame 62. The connecting portion 157 has a slot 157S formed therein for receiving a pin 157P. The slot 157S allows the latch plate cover 162 to slide as well as pivot relative to the pin 157P. The slot 157S has an hour-glass shape across its width so the walls defining the slot are flexible to urge the latch plate cover 162 in one of two directions it can slide to tend to retain the latch plate cover in a closed or open position. The latch cover plate 162 is free to pivot outwardly of the frame 62 when the latch cover plate is axially moved to an open position as indicated by open arrow 159, by virtue of freeing retaining tabs 151, 153 from their respective receiving slots 151S, 153S.

A finger grip 155 is provided on a body portion 160 to move the latch cover plate 162 to an open position permitting access to the recess 122 and blades 22, 24. Each retaining tab 151, 153 includes a ramp 151R, 153R which is received in a respective slot 151S, 153S in the frame 62. The ramps 151R, 153R are tapered to permit relatively easy insertion of the tabs 151, 153 into a slot 151S, 153S and to force the latch cover plate 162 inwardly towards the recess 122 in a direction along the axis AA. This assures that the inwardly facing surface of the latch cover plate 162 engages a bushing 149 on the support member 148 to prevent lateral movement of the blades 22, 24 and support member 148 from the recess 122.

The actuator support 124 (FIG. 8) extends from the frame 62 and includes a pair of fingers 125 spaced apart forming a clevis. The actuator support 124 pivotally receives a mounting portion 164 (FIG. 3) of the actuator 88 between the fingers 125. Thus, the actuator 88 is pivotally fixed to the frame 62 at one end. The actuator 88 includes a rod 166 (FIG. 14) extending therefrom in a direction opposite to the mounting portion 164.

The rod 166 is fixed to a piston 168 (FIG. 17A) for reciprocal movement within a cylindrical chamber 182 in the actuator 88. The piston 168 divides the chamber 182 into a variable volume "open" chamber 184 and a variable volume "cut" chamber 188. When fluid flow under pressure is directed into the open chamber 184 through port 186 and fluid is permitted to exhaust from cut chamber 188, the greater pressure within the open chamber forces the piston 168 and rod 166 to move axially to the right in a blade open direction, as viewed in FIG. 17A. The rod 166 moving in a blade open direction, moves the blade 24, through the drive link 102, in a direction towards the fully open position, as illustrated in FIG. 2. When fluid pressure is directed into the "cut" chamber 188 through port 190, and fluid exhausts from the cut chamber 184, the piston 168 and rod 166 are forced to move to the left in a blade cut direction, as viewed in FIG. 17A. The rod 166 moving in a blade cut direction moves the blade 24, through the drive link 102, towards the fully closed position, as illustrated in FIG. 1. The actuator 88 is located relative to the frame 62 and sized to fit comfortably within the palm of a hand of an operator of the shears 20. The actuator 88 provides sufficient force to cut items, such as small chicken bones.

Figure 3:
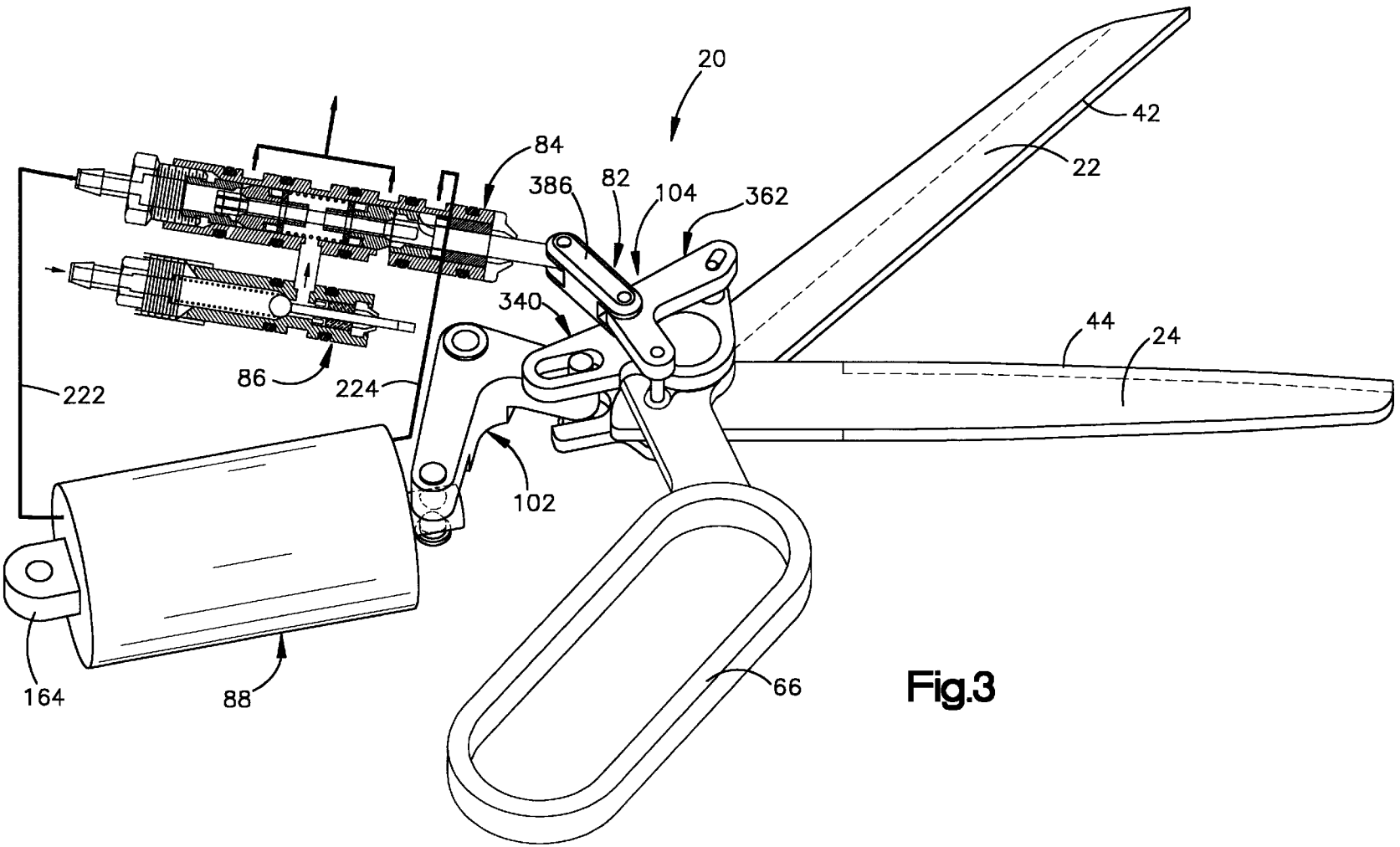
FIG. 3 is a partial perspective view of the shears in FIG. 1 with parts removed for clarity illustrating the major movable parts.
Figure 4:
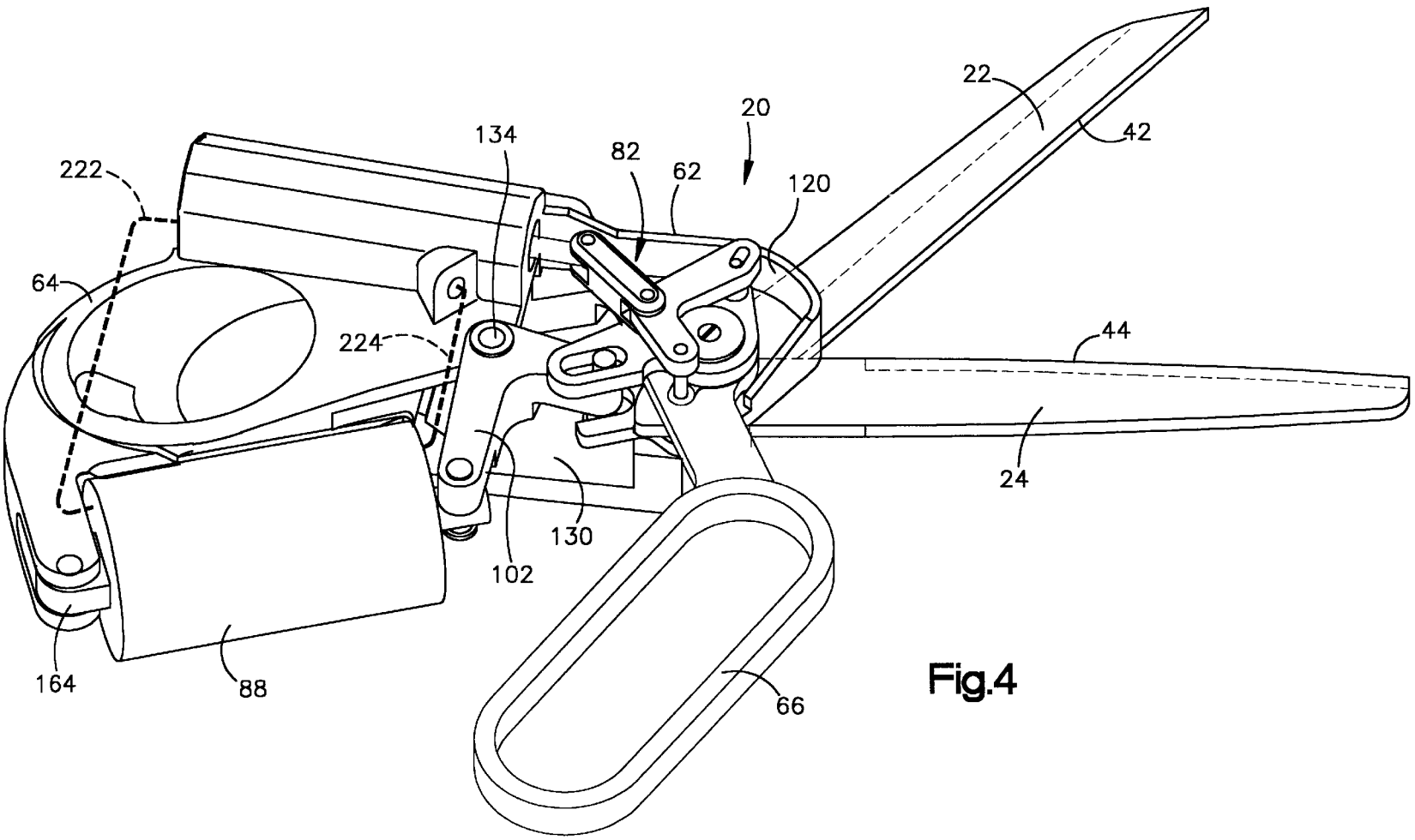
FIG. 4 is a view similar to FIG. 3 illustrating relative positions of some parts of the shears.
Figure 5:
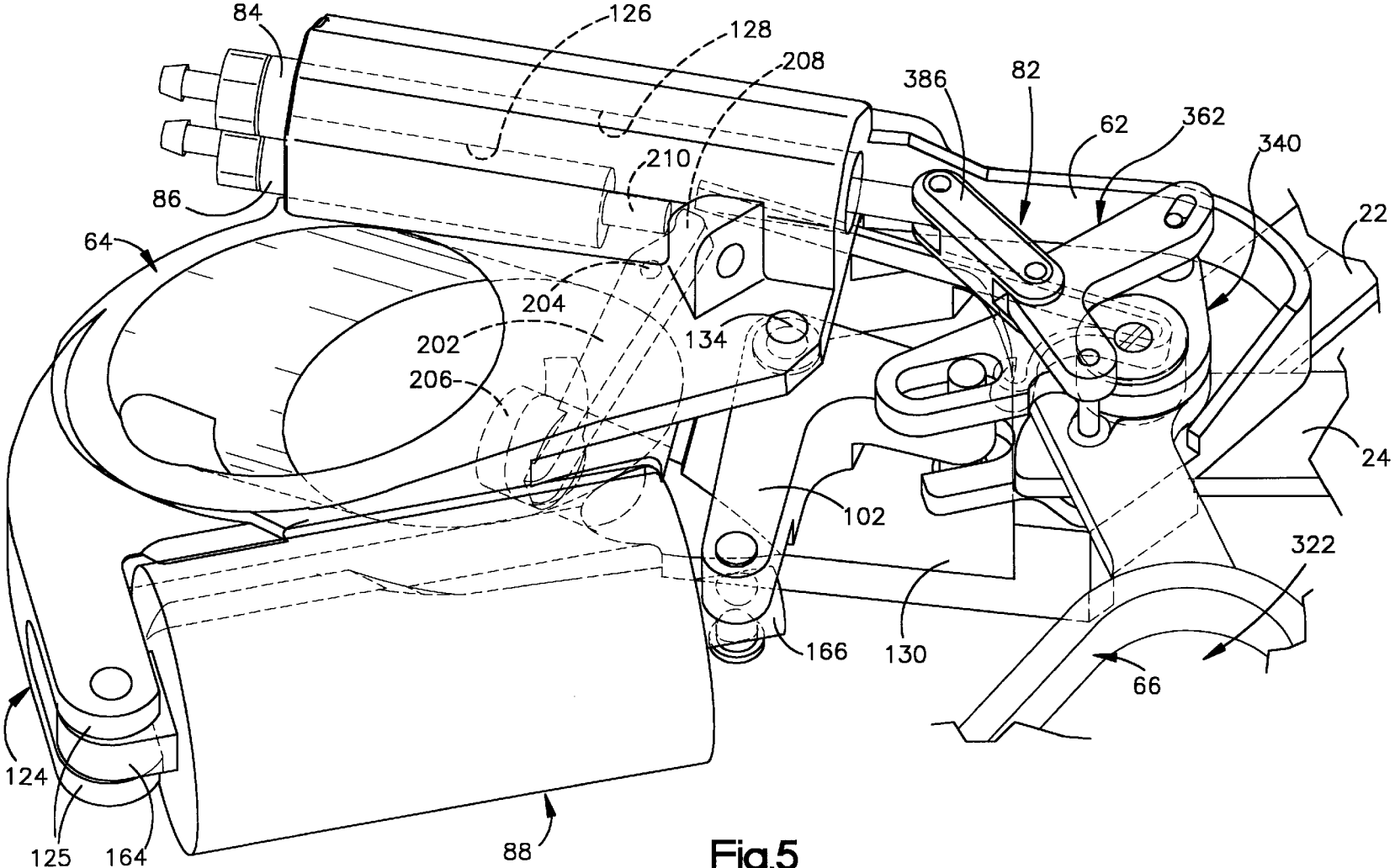
FIG. 5 is an enlarged perspective view of a frame and handle portion of the shears in FIG. 1.
Figure 17A:
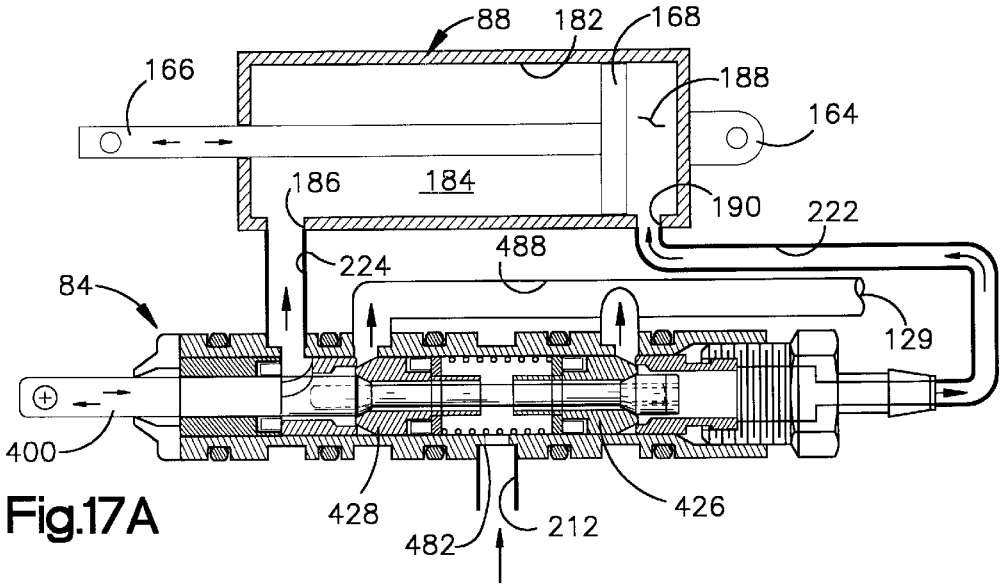
FIG. 17A–H are schematic longitudinal cross-sectional views of the servo control valve in FIG. 16 illustrated with parts in different operating positions.

The servo control valve 84, (FIGS. 3, 16 and 17A–H) is received in the valve chamber 128 which extends completely through the frame 62. The servo control valve 84 is operably coupled to the actuator 88 by fluid conducting lines 222, 224 (FIGS. 3, 4 and 17A). The lines 222, 224 may be located internal or external of the frame 62. Preferably, the lines 222, 224 are external with the line 222 fitting in a groove in the thumb handle portion 64 facing away from the blades 22, 24. The optional safety valve 86 is received in the valve chamber 129 which extends only partially through the frame 62.

An optional safety lever 202 (FIG. 5) is pivotally supported in the thumb handle portion 64 of the frame 62 about a pin 204. A button 206, at the end of one relatively long leg portion of the safety lever 202, extends into the thumb opening 142 of the thumb handle portion 64 under bias of the safety valve 86. When an operator inserts a thumb into the thumb opening 142, the button 206 is depressed and the lever 202 pivots about the pin 204.

A relatively short end portion 208 of the lever 202 moves a rod 210 (FIGS. 5 and 16) in the safety valve 86 to a position permitting fluid pressure from a fluid inlet 211 to the servo control valve 84 through a passage 212. When the button 206 is not depressed, a check valve 216 in the safety valve 86 is biased by a spring 217 to block the flow of pressurized fluid to the passage 212 and the servo control valve 84. This assures that fluid pressure is applied to the actuator 88 to move the blade 24 only when an operator has a thumb in the thumb opening 142 in the thumb handle portion 64 of the frame and can control the shears 20. This optional feature, although shown, is omitted in the preferred embodiment to eliminate a risk that can occur in the event of an interruption in power while the blades are in an open relationship. Without power, the blades will remain open upon the moving of the finger loop 66 to a closed position, which could occur through carelessness or inadvertence, notwithstanding that the loop is spring biased to an open position. In the event of such an occurrence, if the safety lever 202 is operated when the power is returned, the open blades will immediately snap shut, creating a potential danger believed greater than that protected by the safety lever.

A cutting or shearing action is effected during closure of the blade 24 relative to the blade 22 from the position illustrated in FIG. 2 to the position illustrated in FIG. 1. The blade 22 is pivotable relative to the frame 62 about the member 148 and the axis AA. The blade 22 is pivotable in response to movement of the loop handle 66 relative to the frame 62. When the shears 20 are in the fully closed position, as illustrated in FIG. 1, the blades 22, 24 overlie one another in a side-by-side engaged relationship.

Figures 10, 11, 11A, 12, 13, 13A:
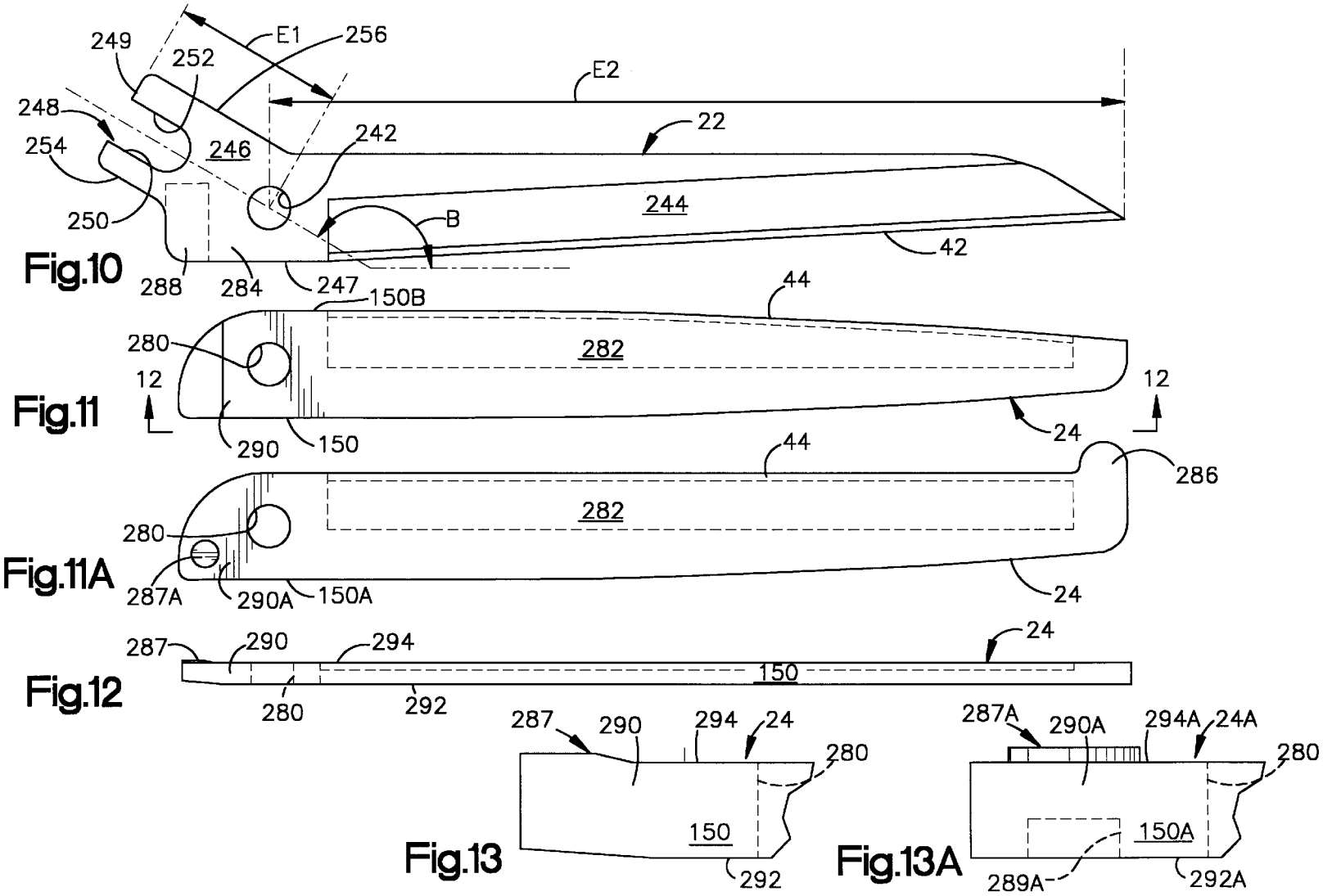
FIG. 10 is a plan view of one replaceable blade of the shears.
FIG. 11 is a plan view of another replaceable blade of the shears.
FIG. 11A is a plan view of an alternate embodiment of the blade illustrated in FIG. 11.
FIG. 12 is a side view of the blade illustrated in FIG. 11 taken along the line 12—12 in FIG. 11.
FIG. 13 is an enlarged view of an axial end portion of the blade in FIG. 12.
FIG. 13A is a view similar to FIG. 13 illustrating an alternate axial end portion of the blade.

The pivotable blade 22 is illustrated in FIG. 10 in detail. The pivotable blade 22 includes an opening 242 extending through the blade and sized to closely fit over the member 149. The pivotable blade 22 includes a relatively long cutting portion 244 extending from the opening 242 and having the cutting edge 42 formed thereon. The pivotable blade 22 includes an actuating portion 246 extending from the opening 242 in a direction away from the cutting portion 244, at an obtuse angle B relative to a straight unground edge portion 247 located directly below the opening 242 and contiguous with the cutting edge 42. The obtuse angle B is in the range of 120° to 170°, and is preferably 144°.

The extent E1 of the actuating portion 246 from the center of the opening 242 is less than the extent E2 of the cutting portion 244 from the center of the opening. The ratio of the extent E2 of the cutting portion 244 to the extent E1 of the actuating portion 246 is in the range of between one to one (1:1) to ten to one (10:1), and preferably is 4.9:1. The extent E2 of the cutting portion 244 is preferably 5 inches from the center of the opening 242 to the tip of the blade. The extent E1 is preferably 1.006 inches from the center of the opening 242 to an end surface 249 of the actuating portion.

Figure 6:
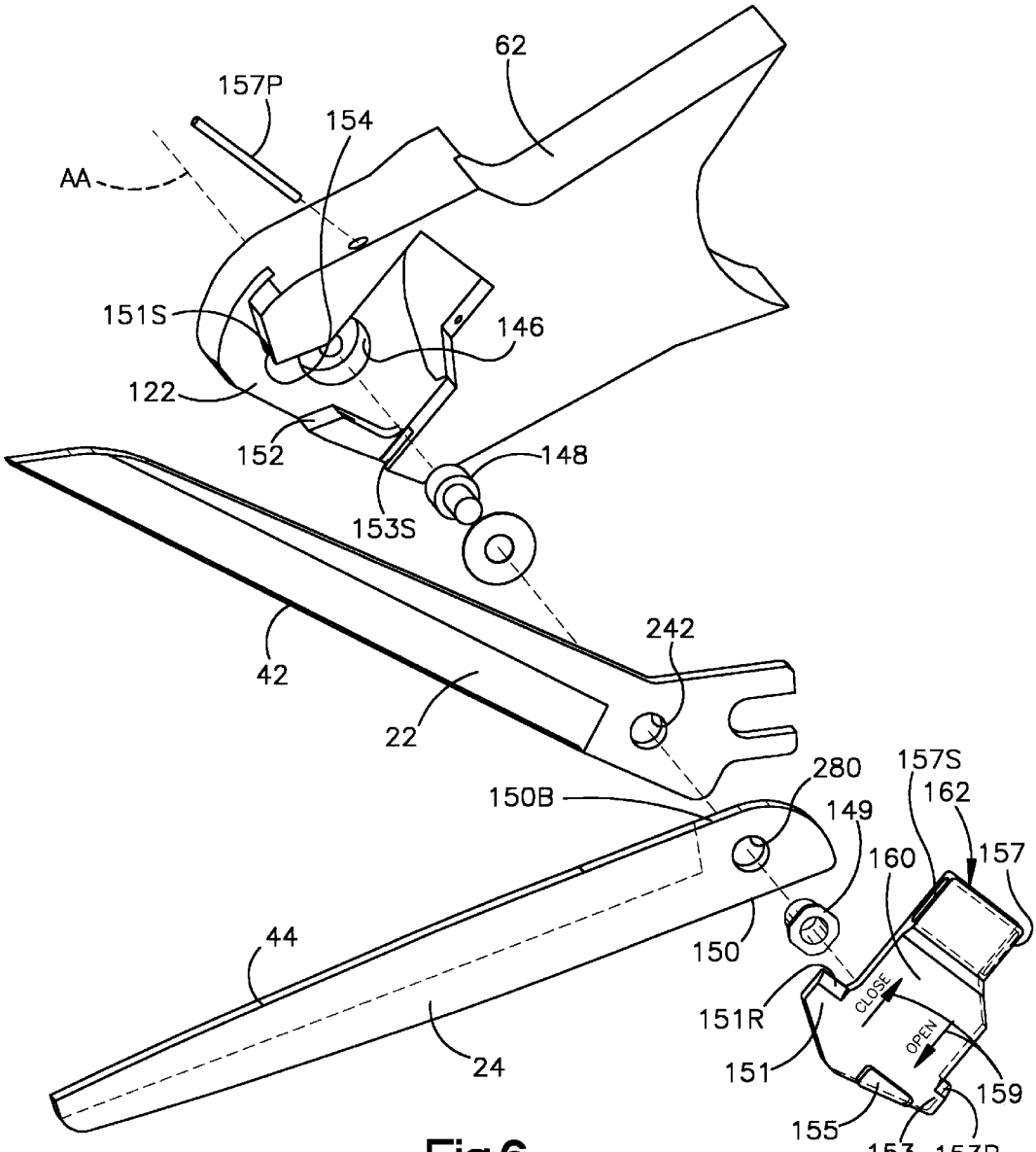
FIG. 6 is an exploded perspective view of a portion of the shears in FIG. 1 illustrating the frame and the blades.

The actuating portion 246 of the blade 22 includes an elongated slot 248 opening through the end surface 249 and extending in a direction toward the opening 242. The slot 248 is defined by two parallel side surfaces 250, 252 extending in a direction substantially parallel to a line extending from the center of the opening 242 at an angle of 144° relative to the unground edge portion 247. The actuating portion 246 also has a pair of substantially parallel extending surfaces 254, 256 extending in a direction parallel to the slot 248 defining side surfaces 250, 252 of the actuating portion. The slot 248 accepts a driving member 258 (FIGS. 14 and 15) of the drive link 102 to force the blade 22 to pivot relative to the fixed blade 24 upon pivoting of the drive link. A heel 284 is located on the actuating portion 246 opposite the opening 242 from the cutting portion 244. The heel 284 includes a ride surface 288 on the blade 22. The fixed blade 24 is illustrated in detail in FIGS. 11–13. The fixed blade 24 includes an opening 280, a cutting portion 282 and a mounting end 290. The opening 280 is formed to closely receive a portion of the support member 148 and 149. The support member 148, blade surfaces 150 and 150B and frame surfaces 152, 154 cooperate to prevent movement of the blade 24 relative to the frame 62 (FIG. 6). The cutting edge 44 of the fixed blade 24 is formed in the cutting portion 282 by grinding and/or polishing. The cutting edge 44 has a straight portion adjacent the mounting end 290 and a distal end portion having a slight curvature; for example, a radius in the range of 30–200 inches. The cutting portions 244, 282 of the respective blades 22, 24 are slightly bowed away from one another between their tips and respective openings 242, 280. An alternative fixed blade 24A (FIG. 11A) includes a ball tip 286 at the end of cutting portion 282A, which aids in eviscerating animal carcasses.

The mounting end 290 (FIGS. 12 and 13) of the fixed blade 24 is located relative to the opening 280 diametrically opposite to the cutting portion 282. The mounting end 290 has a portion 287 bent upwardly, as viewed in FIGS. 12 and 13, during manufacture of the blade 24 away from a lower side surface 292 of the blade, as viewed in FIGS. 12 and 13. This deformed portion 287 of the mounting end 290 assures that the bent portion 287 extends in a direction parallel to the upper side surface 294, but offset, The bent portion 287 of mounting end portion 290 preferably extends 0.010 inch from the upper side surface 294 of the blade 24. The bent portion 287 of mounting end 290 is preferably ground flat after the deforming operation in order to form a surface generally parallel with the upper side surface 294 of the blade 24.

An alternate mounting end 290A (FIG. 13A) of the fixed blade 24A (FIG. 11A) is located relative to the opening 280 diametrically opposite to the cutting portion 282. The mounting end 290A has a portion 287A deformed upwardly, as viewed in FIG. 13A, during manufacture of the blade 24A away from a upper side surface 294 of the blade, as viewed in FIG. 13. This deformed portion 287A of the mounting end 290A is formed by engaging a lower side surface 292A extending in a direction parallel to the upper side surface 294A with a punch to form recess 289. The deformed portion 287A of mounting end portion 290A is forced by the punch and preferably extends 0.010 inch from the upper side surface 294A of the blade 24A. The deformed portion 287A of mounting end 290A is preferably ground flat after the deforming operation in order to form a surface generally parallel with the upper side surface 294A of the blade 24A.

The ride surface 288 (FIG. 10) of the pivotable blade can be interchanged with either raised surface 287 or 287A (FIGS. 13 & 13A) of the fixed blade, as preferred to suit the manufacturing process. These are mating features which cooperate to bias the cutting edges of the blades together.

The cutting edges 42, 44 are adapted to face one another when the blades are properly installed in the frame 62. When the blades 22, 24 are relatively pivoted towards one another, the deformed portion 287 of the mounting end 290 of the fixed blade 4 engages the ride surface 288 in the heel 284 of the pivotable blade 22. The engagement between the deformed portion 287 and the ride surface 288 assures that the cutting edges 42, 44 are continuously biased towards one another to contact and to create a moving cutting point during closure of the blade 22 relative to the blade 24.

Figures 20, 20A:
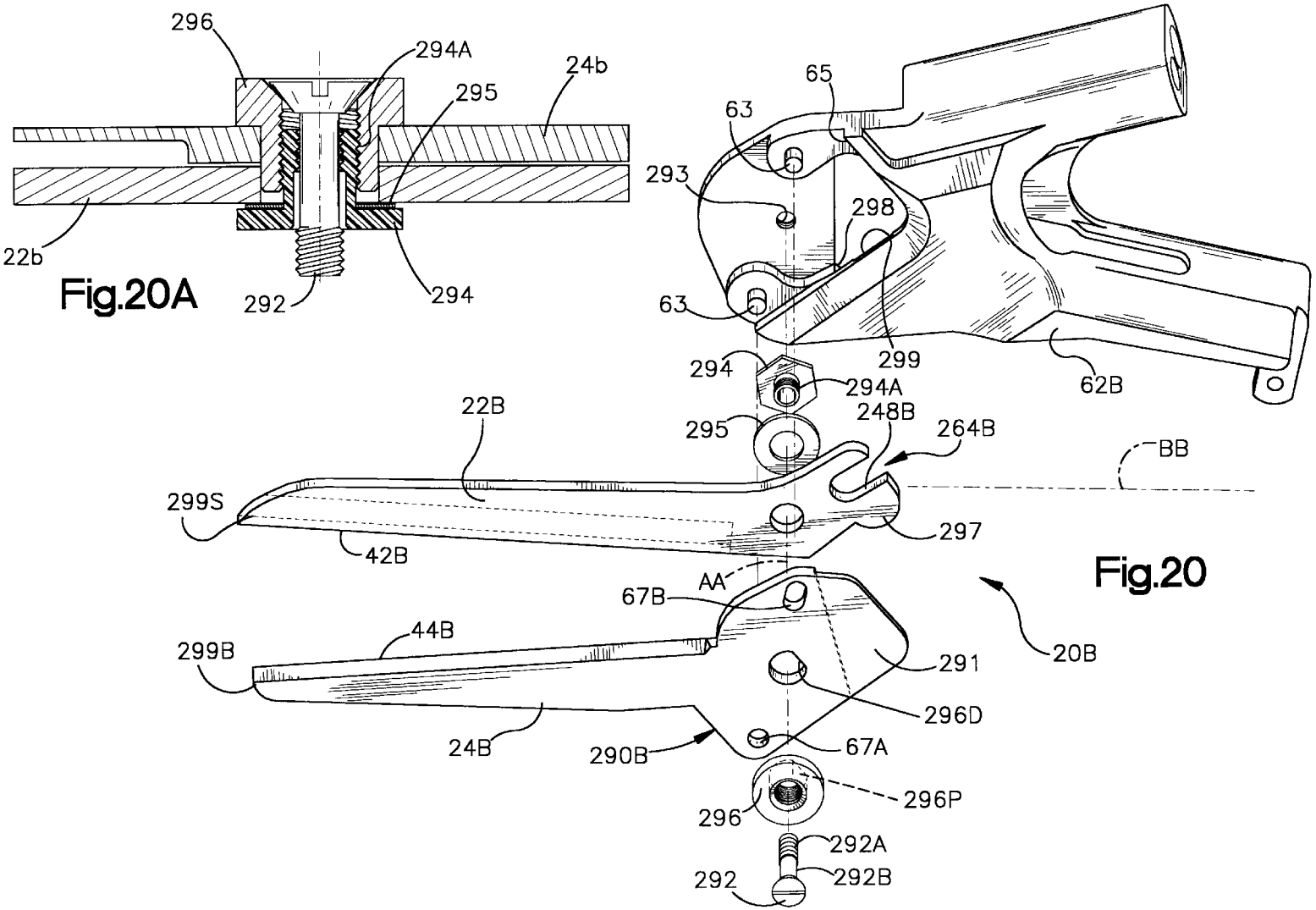
FIG. 20 is an exploded perspective view of the frame and blades in FIG. 19, better illustrating the load bearing mounting arrangement.
FIG. 20A is a detailed view partly in section of a pivoting connection for the blades.
Figure 26:
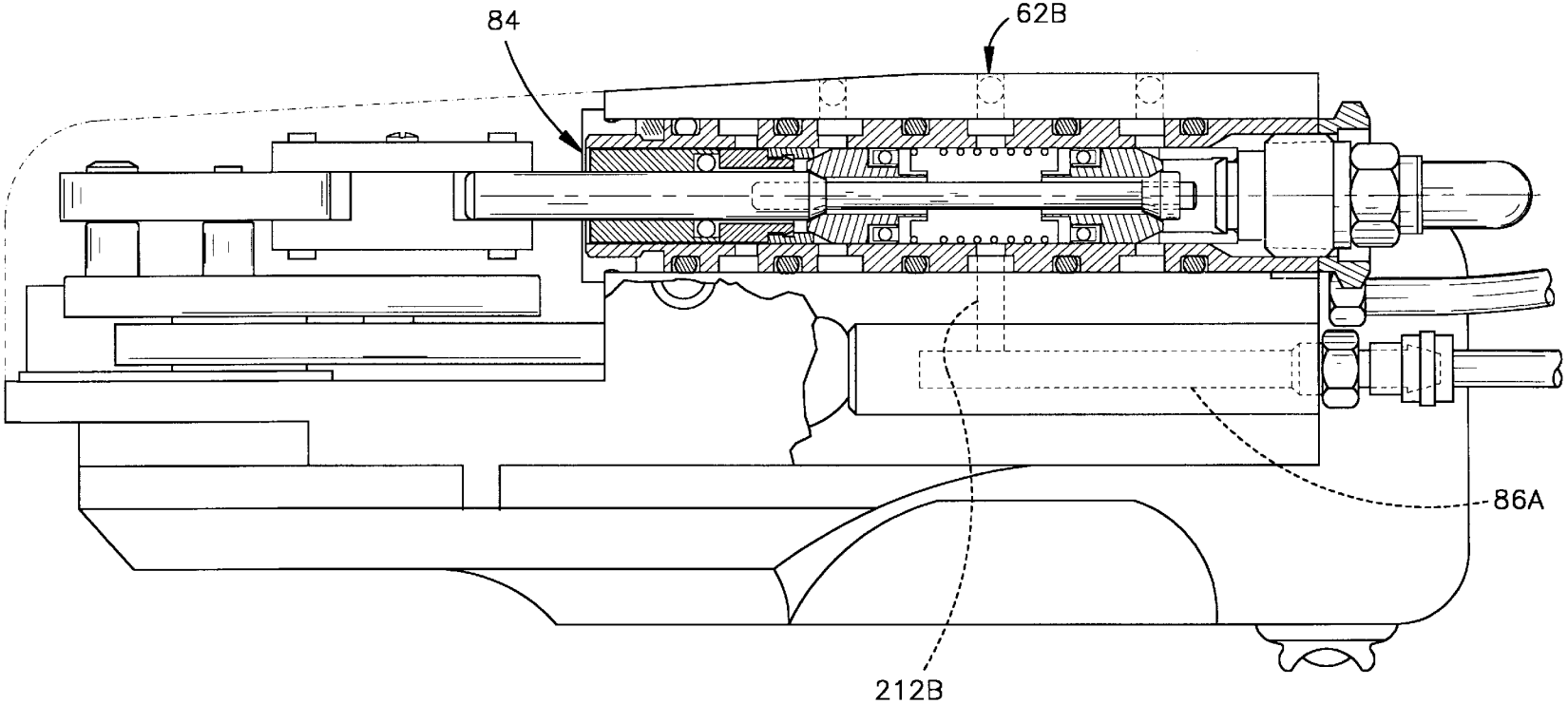
FIG. 26 is a top plan view of the frame of FIG. 19, with the orientation reversed.

Another mounting arrangement between a modified fixed blade 24B and a modified frame 62B of the shears 20B is illustrated in FIGS. 19, 20 and 26. The mounting arrangement between replaceable blades 22B, 24B and the frame 62B is secure and reliable, yet facilitates easy replacement, when the blades are to be changed.

The modified frame 62B has a thumb recess 64B rather than a complete encirclement for the thumb, and employs a strap 62C that extends across the back of the hand of an operator. Also, the safety valve 86 is omitted and a passage 86A extends within the frame, communicating with a cross passage 212B through which fluid under operating pressure is supplied directly to the servo valve 84. The mechanism for operating the blades is otherwise the same as described with respect to the embodiment utilizing the frame 62.

The modified frame 62B includes a pair of load bearing pins 63 fixed to and extending transversely from a cavity portion 65 of the frame. The load bearing pins 63 are located on substantially diametrical opposite sides of the axis AA about which the blade 22B pivots, offset only slightly as indicated at Q1 at FIG. 19 for structural convenience from a precise diametrically opposite relationship. The fixed blade 24B includes a mounting portion 290B that has a substantially planar surface 291 (FIG. 20). The fixed blade 24B includes a pair of openings 67A, 67B formed in its mounting portion 290B. One opening 67A is substantially circular and tightly fits about the exterior of one pin 63. The other opening 67B is elongated into a generally oval or elliptical shape with a width that tightly fits about the other pin 63 and a length that is greater than the diameter of the pin. This elongated opening 67B allows for some manufacturing tolerances in the placement of the openings and/or the pins 63. The wide spacing of the pins 63 and the openings 67A, 67B and their relationship to the pivot axis AA and their fit with the pins 63, results in effective anchoring of the blades and prevents movement of the fixed blade 22B.

The load bearing pins 63 withstand the majority of the load applied between the blades and frame during operation of the blades 22B, 24B as these blades act against a workpiece. The widely spaced pins 63, acting as a couple, bear the shearing load between the blades, and avoid the use of a relatively small edge surface of a blade to engage a part of the frame 62B to absorb such load.

The replaceability and interchangeability of the blades 22B, 24B or other working members as an assembled unit is an important feature of the shears or tool of the present invention. For example, a straight blade assembly is illustrated in FIG. 20. The blades 22B, 24B each have a cutting edge 42B, 44B that is essentially straight along its entire length of approximately 4.00 inches to 4.50 inches. When the cutting edges 42B, 44B of these blades 22B, 24B wear, become dull, otherwise damaged or when the type of blade is required to be changed, they can easily be replaced by closing the blades, loosening a blade screw 292 (FIG. 20) that extends along the axis AA and which connects the blades to a threaded opening 293 in the frame 62B and removing the blades as a unit by lifting them off of the pins 63.

For safety, the removal or replacement of the blades 22B, 24B requires that the blades be in a closed position relative to one another. To insure that the blades 22B, 24B are closed during removal or installation, a portion 297, crescent shaped in the embodiment shown, forms a part of the actuating portion 264B of the pivotable blade 22B. When the pivotable blade 22B of an installed pair is in a position other than the relatively closed position, this crescent shaped portion 297 will be located in an open area of the frame 62B, indicated at 298 (FIG. 20), behind and below a frame portion 299 that interferes with installation and removal of the blades in other than a closed condition. This will be clear from FIG. 19. The pivotable blade 22B must be in its closed position relative to the fixed blade 24B for the crescent shaped portion 297 to be located out of the area 298 formed in the modified frame 62B. This relative location of the crescent shaped portion 297 out of the slot 298 permits the movement of the blades in a direction parallel to the extent of the pins 63. A replacement set of blades 22B, 24B can then be installed or the blades can be serviced or sharpened and then reinstalled.

The blades 22B, 24B are fastened together as a unit by a pivoting assembly (FIG. 20A) which includes a lock nut 294, blade washer 295, pivot nut 296 and the blade screw 292. The lock nut 294 and pivot nut 296 interengage along a threaded portion 294A to maintain the blades 22B, 24B together while also permitting pivotal action relative therebetween. The blade screw 292 extends through both the lock nut 294 and pivot nut 296. A threaded portion 292A is received in the opening 293 to maintain the blades 22B, 24B in the frame 62B and on the pins 63. A smaller diameter nonthreaded portion 292B is located within the lock nut 294 and pivot nut 296 to allow the screw to move freely while engaging or disengaging the thread portion of the Frame 293. This feature allows the screw to remain captured within the blade set when the set is removed from the frame, pivoting of the blade 22B. The pivot nut 296 has a "D" shaped boss 296P on its exterior portion to fit within a "D" shaped opening 296D the fixed blade 24B to prevent relative rotation between the pivot nut and the fixed blade 24B.

Figure 19A:
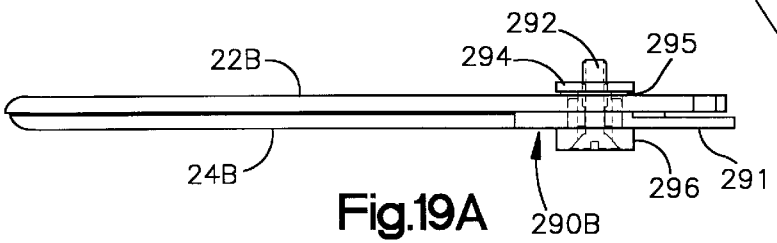
FIG. 19A is a top view of the blades in FIG. 19.

The replaceable blade unit includes the straight blade assembly illustrated in FIGS. 19A and 20, which has relatively straight cutting edges 42B, 44B and a relatively blunt end 299B on the fixed blade 24B. The pivotable blade has a curved end portion with a pointed end 299P (See FIG. 20) The cutting edges 42B, 44B cooperate to shear a workpiece by engaging along a line of contact that is contained in a plane extending substantially parallel to the planar surface 291.

Figure 21:
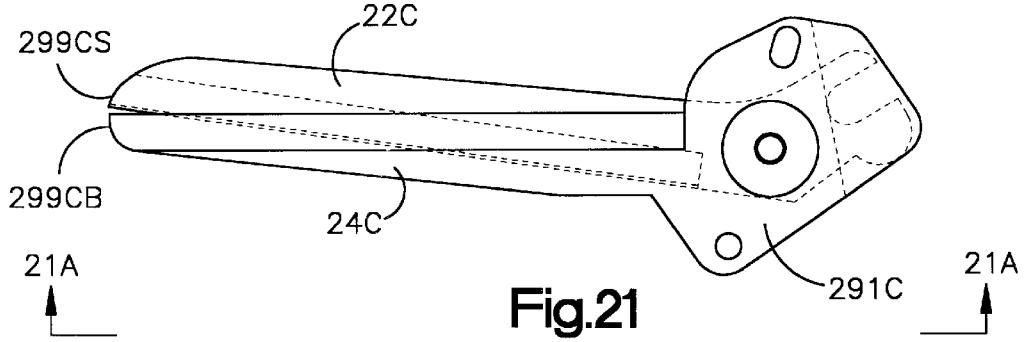
FIG. 21 is a plan view of an alternate embodiment of replaceable blades.
Figure 21A:
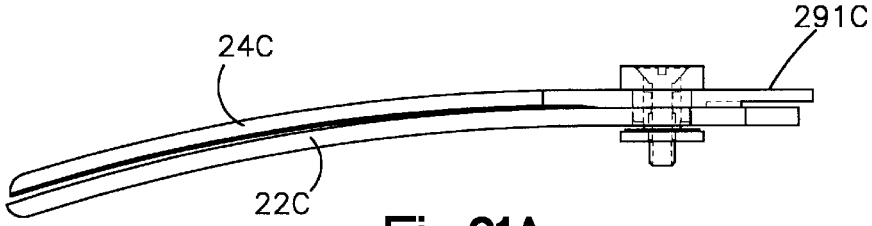
FIG. 21A is a top view similar of the blades in FIG. 21.

As illustrated in FIGS. 21 and 21A a modified version of the replaceable blade unit is illustrated. The blade unit includes a pivotable blade 22C with a pointed end 299CP. A fixed blade 24C has a blunt end 299CB. The blades 22C, 24C engage along a path curved relative to the planar surface 291C of the fixed blade 24C, as illustrated in FIG. 21A. This curvature can be "right hand" as shown, or opposite (not shown).

Figure 22:
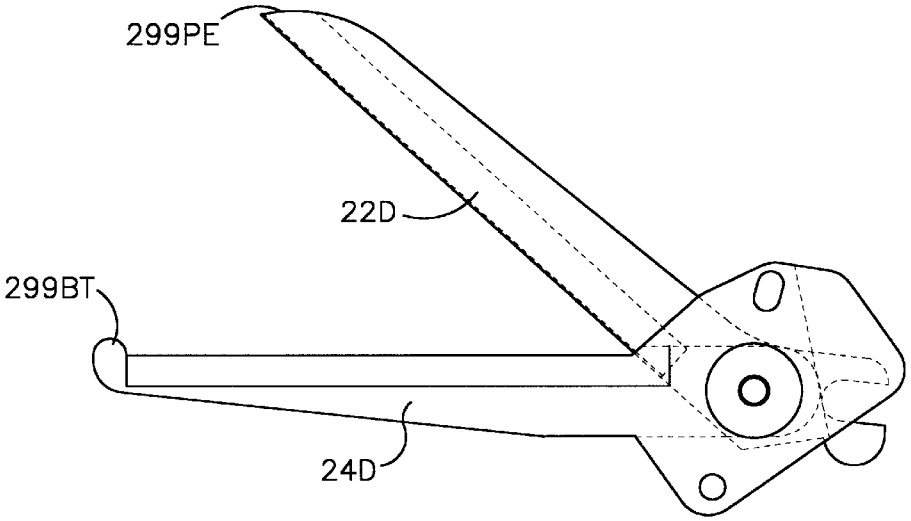
FIG. 22 is a plan view of another alternate embodiment of replaceable blades.

As illustrated in FIG. 22, another replacement blade unit includes a fixed blade 24D having a ball tip 299BT. The ball tip 299BT permits the fixed blade 24D to be inserted into a narrow channel in the workpiece without cutting or digging into the surface. A pivotable blade 22D includes a relatively sharp pointed end 299PE which can be used to puncture a product or workpiece.

Figure 23:
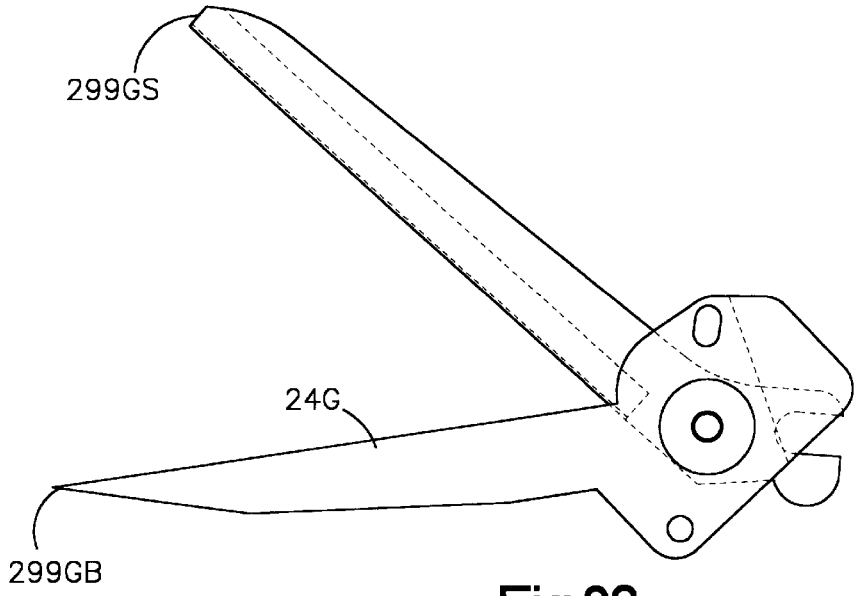
FIG. 23 is a plan view of another alternate embodiment of replaceable blades.
Figure 24:
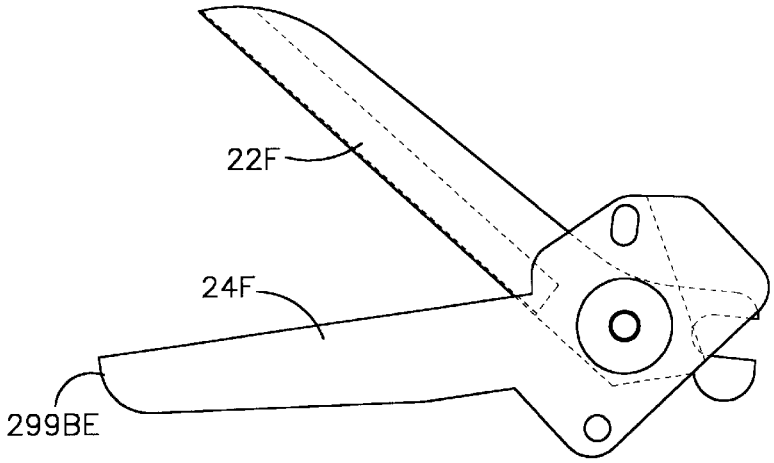
FIG. 24 is a plan view of another alternate embodiment of replaceable blades.
Figure 25:
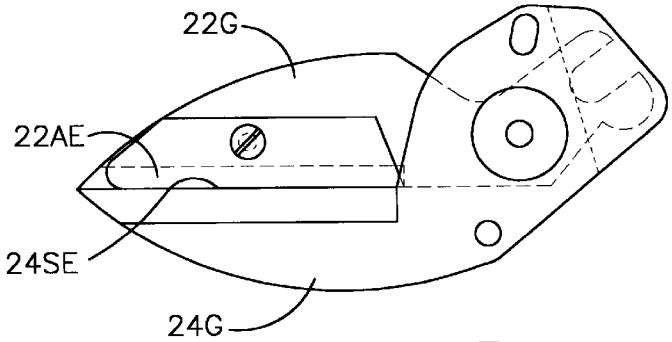
FIG. 25 is a plan view of another alternate blade embodiment.

A replaceable blade unit illustrated in FIG. 23 is designated a "gizzard" blade assembly. The fixed blade 24G has a relatively sharp pointed end 299GB to impale a product or workpiece. The pivotable blade 22G has a squared end 299GS. As illustrated in FIG. 24 a replaceable blade unit is a straight short blade assembly. The blades 22F, 24F are relatively shorter than the blades 22B, 24B illustrated in FIG. 20. The fixed blade 24F has a raised blunt end 299BE. A replaceable blade unit illustrated in FIG. 25 is described as a "neck breaker" blade assembly. The blades 22B, 24B are relatively thick, taken in the direction of relative pivotal movement and, thus, are relatively strong in that direction. These blades are typically used for breaking bones in a poultry workpiece such as a chicken or turkey. The neck breaker blade assembly has its pivotal blade 22G with a removable anvil edge 22AE. The anvil edge 22AE is relatively wide, taken in a direction normal to the direction of relative pivotal movement. This blade 22G cuts by forcing the work product against and into a sharp edge 245E of the fixed blades 24G as the blunt anvil cutting edge and the sharp cutting edge are brought into mutual contact crushing when the moveable anvil edge 22AE is brought into engagement with a sharp edge 24SE of the fixed blade 24G. Such a forceful engagement between the two blades can also be used by other working members such as a power operated crimping tool with suitable crimping edges.

Figure 14:
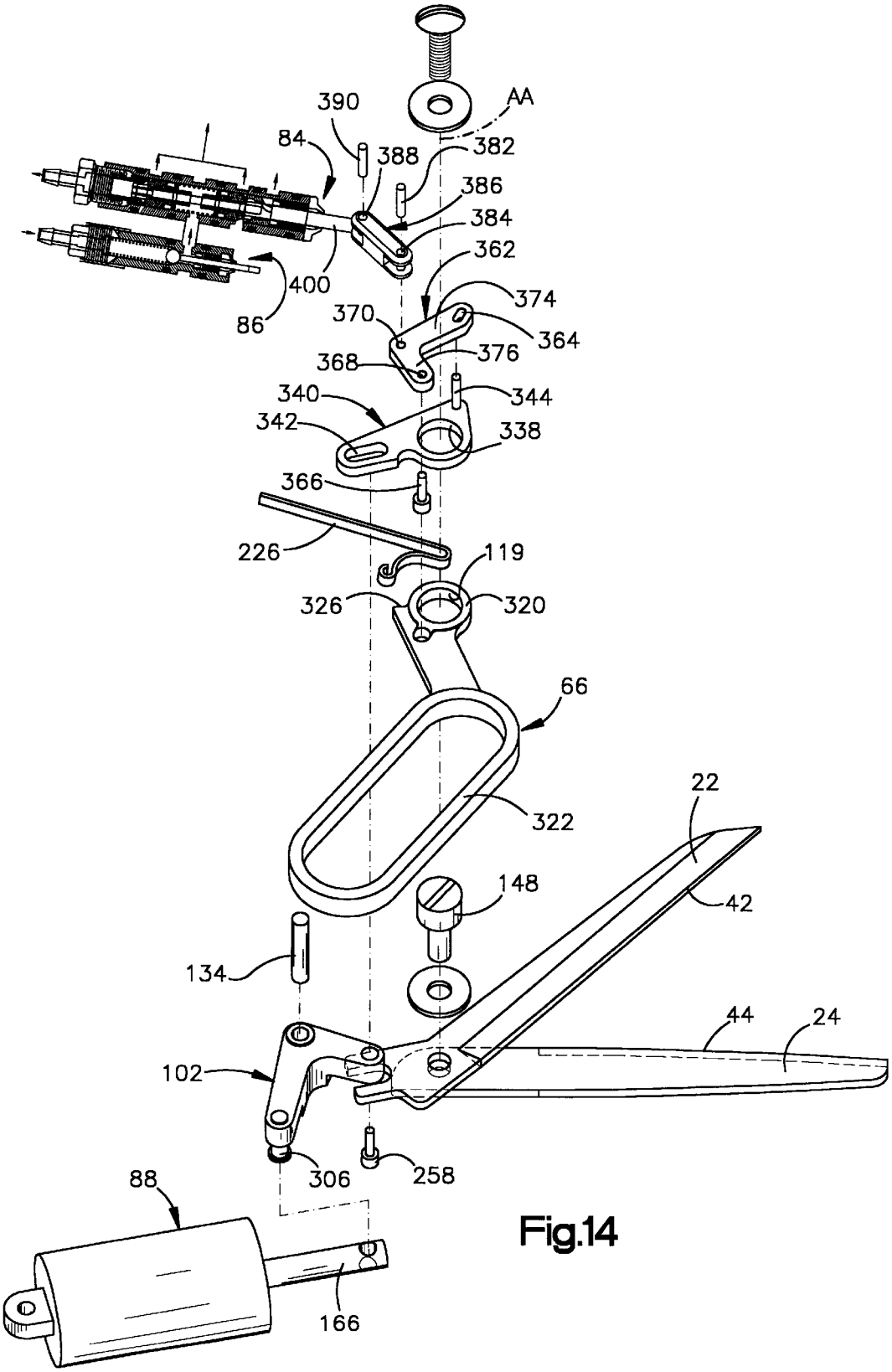
FIG. 14 is an exploded perspective view of the major movable parts of the shears in FIG. 1.
Figure 15:
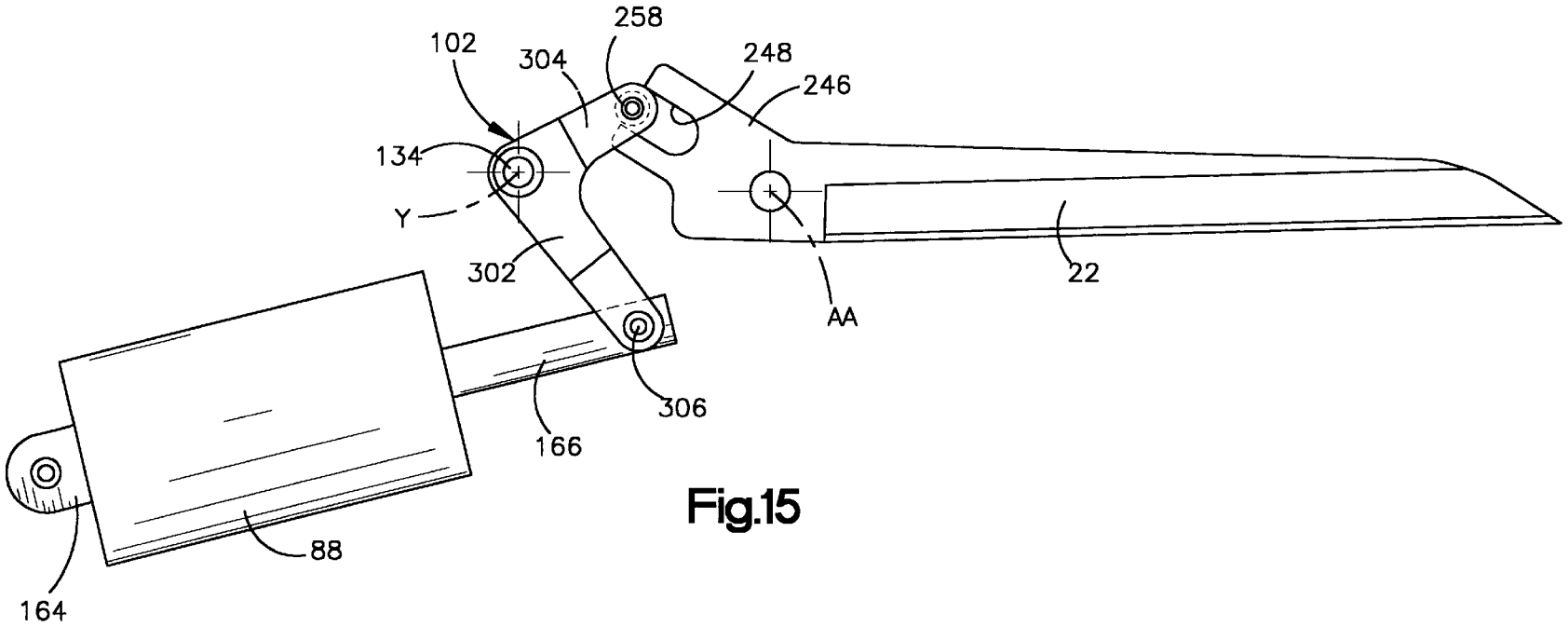
FIG. 15 is a plan view of a fluid power actuator, drive link and blade of the shears.
Figure 16:
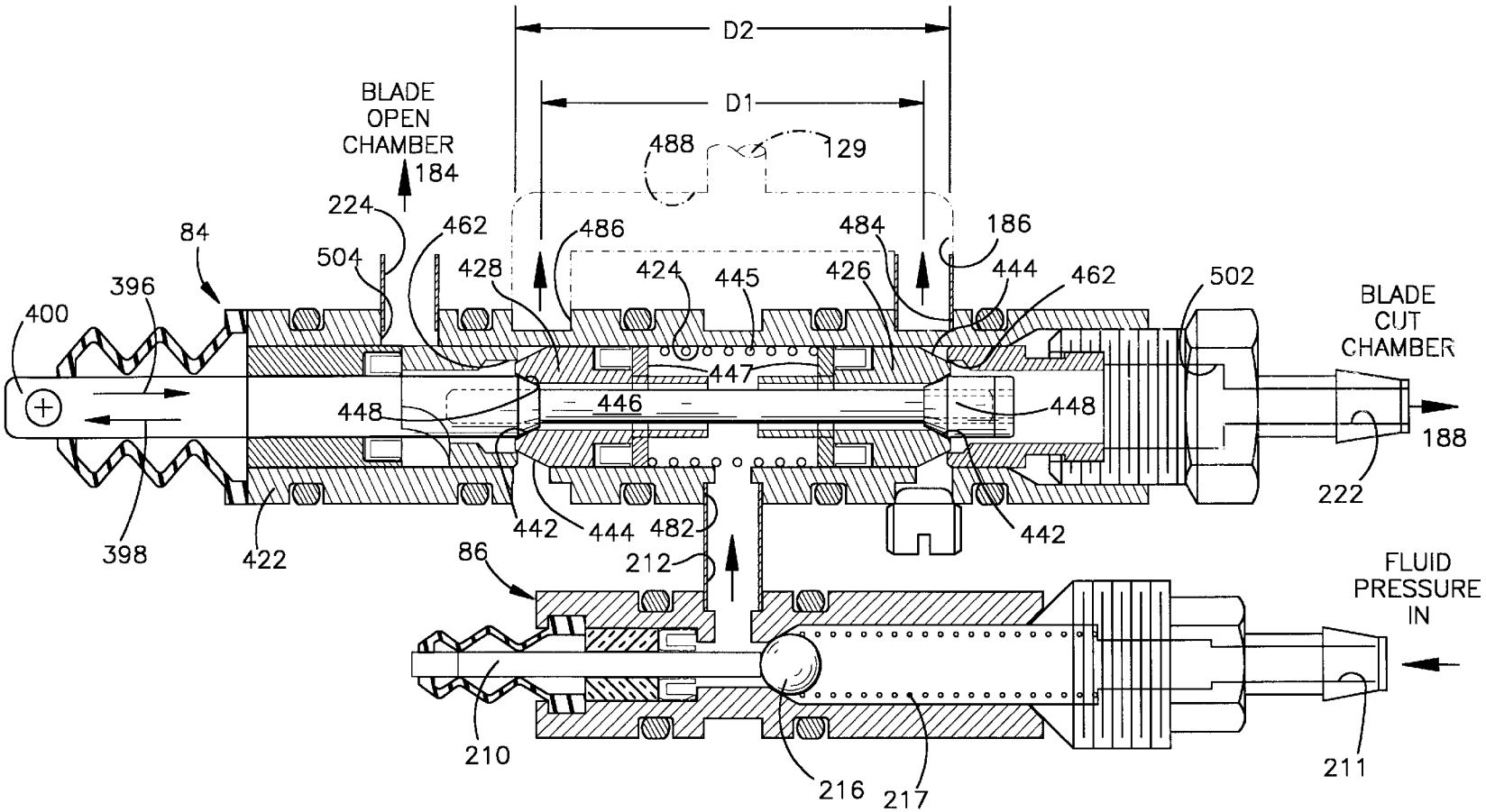
FIG. 16 is an enlarged longitudinal cross-sectional view of the servo control valve and safety valve of the shears.

The drive link 102 is a bell crank member having a general L-shape. As illustrated in FIGS. 14 and 15, the drive link 102 is connected for pivotable movement about the pin 134. The pin 134 is received in the openings of the frame 62 and is located approximately along the longitudinal center line of the fixed blade 24. The drive link 102 pivots in the frame 62 at a location between the rod 166 of the actuator 88 and the slot 248 of the pivotable blade 22. A relatively longer leg 302 of the drive link 102 is connected with the rod 166 by a pin 306. The distance between the centers of the pins 134 and 306 is preferably 1.24 inches. The relatively shorter leg 304 of the drive link 102 is connected with the actuating portion 246 of the pivotable blade 22. The linkage between the leg 304 and the slot 248 of the pivotable blade 22 is through the pin and roller 258, which is in rolling engagement with the blade. The distance between the centers of the pins 258 and 134 is preferably 0.83 inch.

The ratio of the distances of the longer leg portion 302 to the shorter leg portion 304 is in the range of 1.15:1 to 1.85:1 and is preferably about 1.50:1. This "leg ratio" being greater than 1.0 provides an increase in force transmitted to the actuating portion 246 of the blade 22 compared to the force applied to the drive link 102 by the rod 166. This force multiplication due to the mechanical advantage provided by the drive link 102 enables a relatively large cutting force to be applied between the blades 22, 24. Concurrently, a decrease in angular travel of the blade 22 compared between the angle of travel of the long leg 302 occurs as the blade is closing. The decreasing angular travel produces a proportionately increasing amount of force applied to blade 22, which compensates in part for the drop in cutting force that occurs as the cut point moves toward the end of the blade.

Pivotable movement of the drive link 102 about the pin 134 pivots the blade 22 about axis AA through engagement of the blade by the pin 258 in the slot 248. For example, when the rod 166 of actuator 88 is forced to move axially to the left, as viewed in FIG. 15, the longer leg portion 302 of the drive link 102 pivots clockwise about the pin 134 causing the leg portion 304 to follow with clockwise pivotal movement about the pin. However, the arcuate movement at pin 258 is less than the arcuate movement at pin 306. This results because the distance from the centers of pin 134 to pin 258 is less than the distance from the centers of pin 134 to the center of pin 306. To accommodate the pivoting of the blade 22 and the link 102, while keeping the construction compact, the slot 248 begins at least within 0.55 inch from the axis AA and extends a distance of at least 1.0 inch from the axis AA.

The finger loop handle 66 is received in the recess 120 in the frame 62. The finger loop handle 66 pivots relative to the support 118 about the same axis AA as the blade 24 pivots. The finger loop handle 66 pivots about 20° to 25° relative to the frame 62 between the fully open position illustrated in FIG. 2, and the fully closed position illustrated in FIG. 1, or about half of the arcuate movement of the pivotable blade 22. The finger loop handle 66 includes a finger handle portion 322 for receiving therein up to four fingers of an operator's hand located opposite the thumb. The finger handle portion 322 is preferably continuous and closed which allows an operator's fingers to move the loop handle 66 in both directions for pivotable movement about the support 118, and also acts as a guard for the fingers.

A pivot portion 320 of the loop handle 66 surrounds the support 118 and is narrower than the width of the finger handle portion 322. The return spring 226 engages an end surface 326 on pivot portion 320 of the finger loop handle 66 to continuously bias the finger loop handle portion 322 towards the fully open position, as illustrated in FIG. 2.

A blade link 340 (FIG. 14) forms a part of the feedback linkage 104. The blade link 340 is also received on the support member 118 at opening 338 for pivotable movement about the axis AA. The blade link 340 is located in the recess 120 of the frame 62. The blade link 340 is axially offset from the pivot portion 320 of the loop handle 66.

The blade link 340 detects movement of the pivotable blade 22 and communicates that movement to a difference link 362 in the feedback linkage 104. The blade link 340 detects movement of the pivotable blade 22 at one end by engagement with the pin 258 in the drive link 102 that extends through a slot 342 of the blade link. The movement of the blade link 340 is transmitted to the difference link 362 through a pin 344 at a location relative to the opening 338 which is generally opposite the slot 342. The distance from the axis AA at which the pin 258 engages a surface defining the slot 342 of the blade link 340 is in the range of 0.73 to 0.96 inch. The distance to the center of the pin 344 from the axis AA is 0.46 inch. The pin 258, thus, moves through an arcuate distance greater than the arcuate distance that the pin 344 moves and is proportionately greater by a ratio in the range of about 1.5:1 to about 2.1:1.

The difference link 362 is connected between the pin 344 of the blade link 340 and a pin 366 on the finger loop handle 66. The difference link 362 forms part of the feedback linkage 104 and communicates a difference between pivotal movement of the blade 24 and the pivotal movement of the finger loop handle 66 to the servo control valve 84.

The difference link 362 is a generally L-shaped member formed by legs 374, 376 meeting at an apex. A pin 382 in an aperture 370 at the apex communicates movement of the apex to an actuator link 386 of the servo valve 84. The difference link 362 includes a slot 364 in leg 374 for receiving the pin 344 of the blade link 340 and an opening 368 in the leg 376 for receiving the pin 366 of the finger loop handle 66. The distance from the center of the opening 368 in one leg 376 of the difference link 362 to the center of the aperture 370 at the apex is shorter than the distance between the center of the aperture 370 to the average center of the slot 364 in the other leg 374. The difference link 362 has a ratio of the length of leg 374 to the length of leg 376 in the range of about 1.3:1 to 1.7:1. Thus, a relatively larger proportion of movement of the finger loop handle 66 is communicated to the servo control valve 84 than the proportion of movement of the pivotable blade 22.

Figure 18:
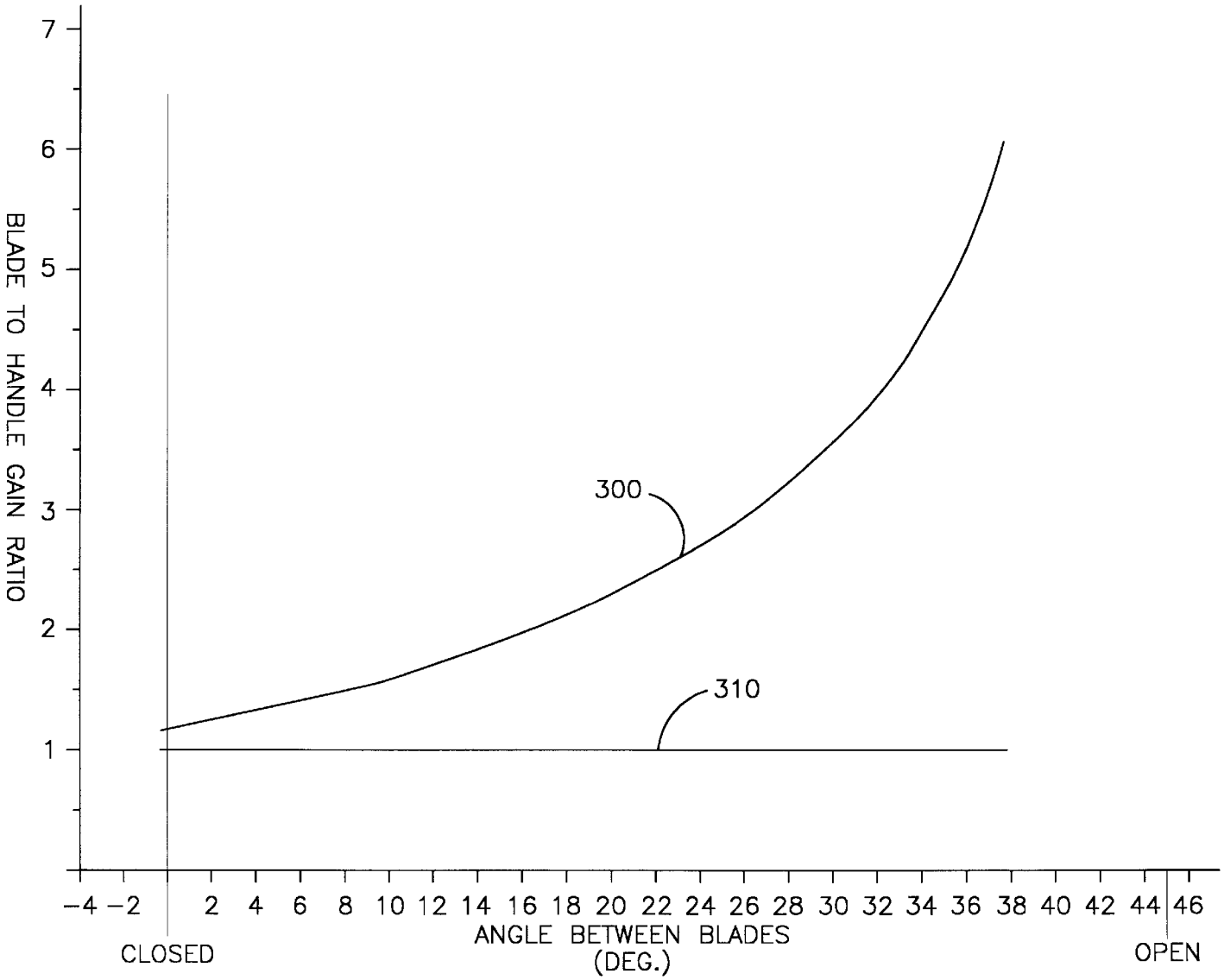
FIG. 18 is a graph representing the ratio of the change in blade angle relative to the change in handle angle as a function of the relative angle between the blades.

The offset distance of the aperture 370 from a line from the centers of openings 368 and slot 364 on link 362 results in a decrease in speed of movement as the blade 22 nears the closed position. This decrease in speed of movement of the blade 22 relative to the movement of the handle 66 is represented by curve 300 in FIG. 18 as "blade gain ratio." The blade gain ratio is plotted as a function of the angle between the blades 22, 24. This noticeable gain ratio means that the change in angle between the blades 22, 24, to the change in angle between the handle 66 and the frame 62, decreases from over a 6:1 ratio at the fully open position to about 1:1 at the closed position. This is compared to the constant 1:1 ratio of conventional scissors in curve 310. The variable "blade gain ratio" is particularly advantageous for controlling cutting with a relatively slow closure rate near the fully closed blade position.

A pin 382 received in the aperture 370 at the apex of the difference link 362 extends into an opening 384 of the actuator link 386. The actuator link 386 includes an opening 388 at an end opposite to the opening 384. The opening 388 receives a pin 390 that is connected with a stem 400 in the servo control valve 84.

The actuator link 386 transmits motion of the difference link 362 to the stem 400 in the servo control valve 84. Because the difference link 362 reflects the difference in pivotal movement between the loop handle 66 and the pivotable blade 22 and moves the actuator link 386 and, hence, the stem 400 in the servo control valve 84, it provides a difference feedback signal to the servo control valve.

For example, the finger loop handle 66 is pivoted by an operator from the open position to the closed position nearer the frame 62 when the blades 22, 24 are in the fully open position, as illustrated in FIG. 2. The difference link 362 then pivots clockwise about the pin 344 by the pin 366 in the finger loop handle 66. The pin 382 forces the actuator link 386 to move the stem 400 axially inward within the servo control valve 84, in a direction that causes the pivotable blade 22 to move towards the closed position. There is a time lag before the piston 168 and the power rod 166 of the actuator 88 force the pivotable blade 22 to pivot towards the closed position that is illustrated in FIG. 1. During this time lag, until the blade 22 begins to pivot, the difference link 362 has pivoted only about the pin 344 supported in the blade link 340. Once the blade 22 begins to pivot, the position of the difference link 362 then reflects a tendency to pivot about pin 366. If the finger loop handle 66 continues to move ahead of the blade 22 movement, then movement of pins 366, 344 tend to cancel their influence on the difference link 362 and produce an apparent rotation about pin 382. The actuator link 386 essentially maintains its position and the blade 22 continues to pivot. If the blade 22 movement tends to catch up to the finger loop handle 66 movement, the difference link 362 pivots about pin 366, causing the actuator link 386 to move the stem 400 in a direction axially out of the valve 84, reducing the flow of fluid to the actuator 88 and, hence, showing or stopping pivoting of the blade 22.

Figure 17B:
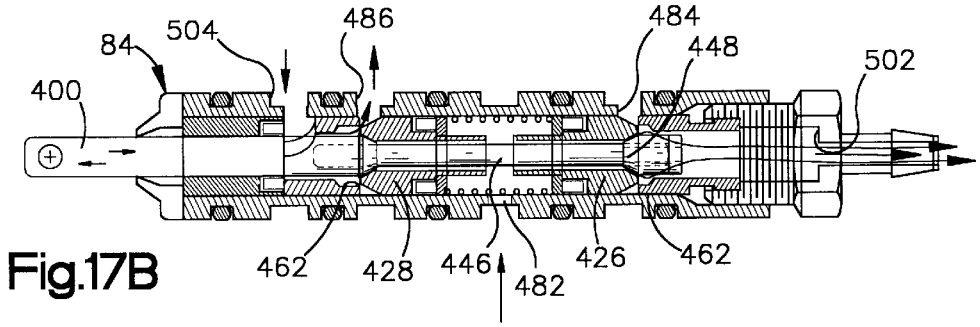
Figure 17C:
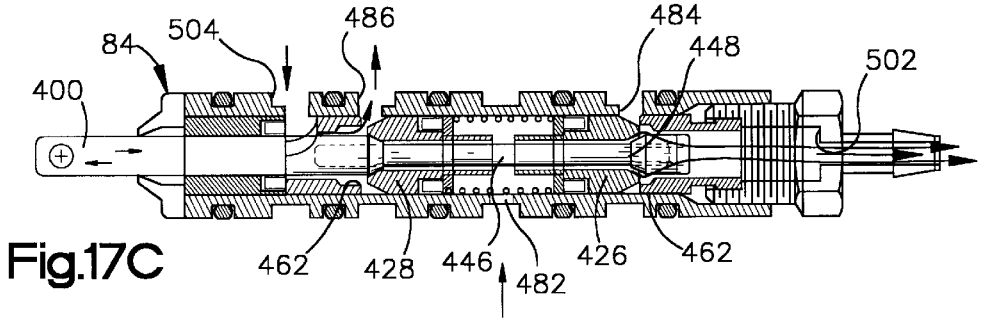
Figure 17D:
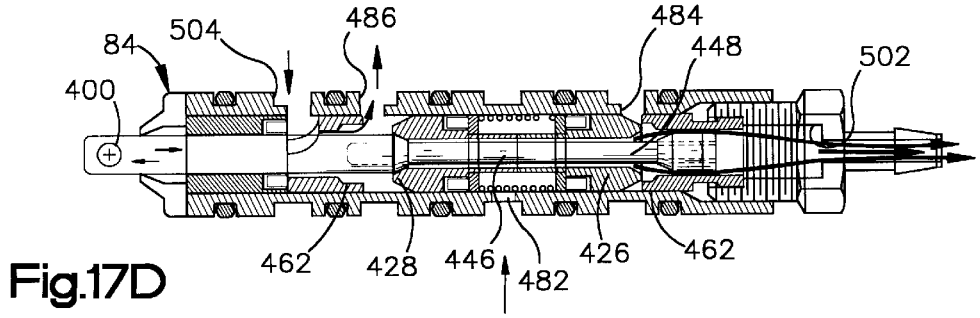

Thus, the servo control valve 84 is actuated from the position illustrated in FIG. 17A through the position illustrated in FIGS. 17B through 17D by movement of the difference link 362. The travel limit of the stem 400 within the servo control valve 84 is illustrated in FIG. 17D. During the axial inward movement or cut signal, indicated by the arrow 396 (FIG. 16), of the stem 400 within the servo control valve 84, fluid is directed to the line 222 to the port 190 and into the "cut" chamber 188 in the actuator 88. This forces the piston 168 and its associated rod 166 to move in a cut direction and move the blade 22 from the open position towards the closed position. The rod 166 forces the drive link 102 to pivot the pivotable blade 22 toward the fixed blade 24 with a cutting action.

During this pivotable movement of the pivotable blade 22 towards the fixed blade 22, the blade link 340 communicates the movement of the pivotable blade to the difference link 362. The difference link 362 pivots about the pin 366 in a clockwise direction which causes the actuator link 386 to pull the stem 400 in a direction axially outward of the servo control valve 84. The pivotable blade 22 tries to catch up to the desired position indicated by the position of the finger loop handle 66 relative to the frame 62. The difference link 362 continues to pivot clockwise about the pin 366. The pivotable blade 22 does eventually catch up to the desired blade position indicated by the position of the loop handle 66 relative to the frame 62.

The difference link 362 detects that the position of the pivotable blade 22 relative to the blade 24 or frame 62 has caught up to the desired position indicated by the position of the loop handle 66 relative to the frame 62. The difference link 362 stops rotating about either pin 366 or 344. No motion is, thus, imparted to the actuator link 386 and the stem 400 is in a "neutral" position, illustrated in FIG. 17G, which does not cause any further pivoting of the blade 22 from the position it was in when the stem reached the neutral position. It will be apparent that from the position that the blade 22 stopped, it could thereafter be opened, closed or could remain stationary relative to the blade 24, as long as the blade 22 is between the fully open or fully closed positions when it stopped moving.

To move the blade 22 towards the open position of FIG. 2, the reverse takes place. The loop handle 66 is pivoted away from the frame 62 towards the fully open position illustrated in FIG. 2. This forces the pin 366 to pivot the difference link 362 at opening 368 counterclockwise about the pin 344. This pivoting motion of the difference link 362 imparts a force to the actuator link 386 that pulls the control stem 400 in a direction axially outward of the servo control valve 84 towards the position illustrated in FIG. 17H.

Such axially outward motion causes fluid to flow through line 224 to port 186 and into open chamber 184. Fluid pressure forces the piston 168 and rod 166 to move in a direction towards the mounting portion end 164 of the actuator 88. This axially inward movement of the rod 166 in the actuator 88 causes the drive link 102 to pivot in a clockwise direction about the pin 134 which causes the actuating portion 246 of the blade 22 to pivot about the axis AA in a counter-clockwise direction. Pivoting of the drive link 102 in a clockwise direction causes the blade 22 to move from the closed position illustrated in FIG. 1 relative to the fixed blade 24 toward the open position illustrated in FIG. 2.

Figure 17E:
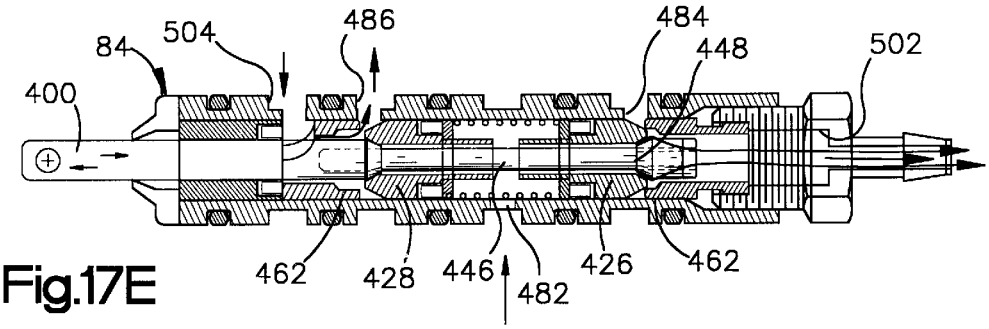
Figure 17F:
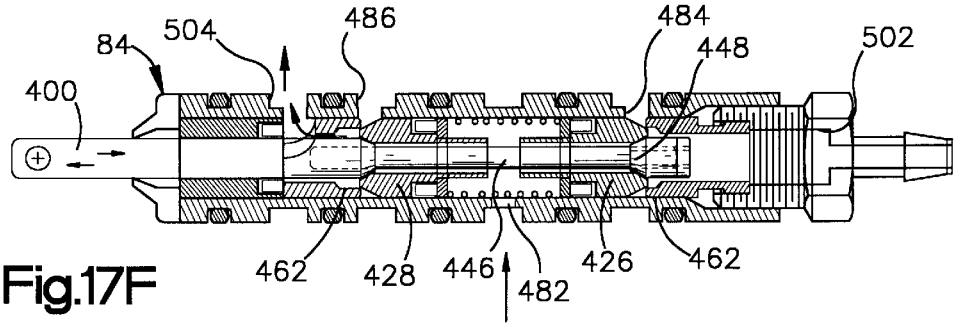
Figure 17G:
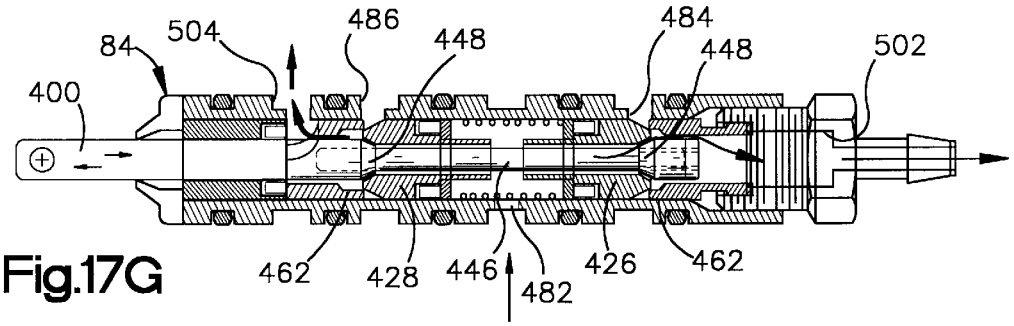
Figure 17H:
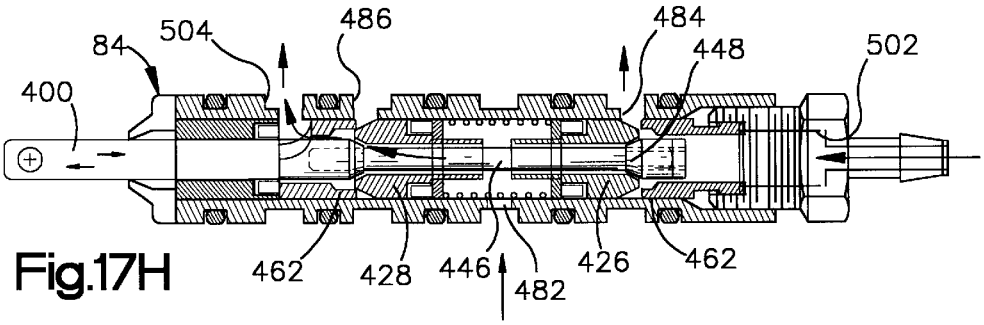

Thus, the stem 400 moves from the position in the servo control valve 84 illustrated in FIG. 17G progressively to the position illustrated in FIG. 17H. The position illustrated in FIG. 17H is a reversing travel position or a position in which opening motion of the blade 22 will occur.

The servo control valve 84 (FIG. 16) controls fluid flow to the actuator 88. The servo control valve 84 includes a valve body 422 that defines an elongated chamber 424. Two oppositely facing pistons 426, 428 are independently movable longitudinally within the chamber 424 of the valve body 422. Each piston 426, 428 has an inner annular first valve seat 442 and an outer annular first obturating surface 444. A reciprocable valve stem 446 extends through and is at least partially surrounded by the pistons 426, 428. The valve stem 446 is connected to and is part of stem 400. Each of the pistons 426, 428 includes a surface 447 for transmitting force to the piston in a direction away from the other. The servo control valve 84 may optionally include a compression spring 445 between and acting concurrently against the force transmitting surface 447 associated with each piston 426, 428.

Two oppositely facing spaced annular second obturating surfaces 448 are carried by the valve stem 446 at opposite ends a fixed distance D1 apart. The pistons 426, 428 are located between the two second obturating surfaces 448 and are reciprocable relative to the valve stem 446. Each of the second obturating surfaces 448 are arranged to cooperate with one of the inner annular first valve seats 442 to control fluid flow along the valve stem 446 from the fluid inlet 212 intermediate the pistons 426, 428.

Two annular second valve seats 462 are fixed in the valve body 422. Each of the second valve seats 462 is located to coact with the outer annular first obturating surfaces 444 of one of the pistons 426, 428. This contact limits the longitudinal movement of the pistons 426, 428 in a direction away from each other and controls fluid flow past the outer annular first obturating surfaces 444.

A first port 482 to the chamber 424 is located between the pistons 426, 428 and serves as a fluid inlet to the chamber. A second port 484 and a third port 486 are for separate fluid communication with the chambers 184, 188 through lines 222, 224, respectively. The second port 484 and the third port 486 communicate independently with a common passage 488 in the frame 62 for exhausting fluid from the servo control valve 84 and shears 20 at exhaust port 129. The second port 484 and third port 486 are associated with a respective one of the second valve seats 462 for exhausting fluid from the chambers 184, 188. The second port 484 is closable by the right piston 426, as viewed in FIG. 16, to block fluid flow from the chamber 188 to the common passage 488. The third port 486 is closable by the left piston 428, as viewed in FIG. 16, to block fluid flow from the chamber 184 to the common passage 488.

A fourth port 502 and a fifth port 504 to the chamber 424 are each located longitudinally outward of the pistons 426, 428 and their associated second valve seats 462. The fourth port 502 is for supplying fluid to and receiving fluid from the "cut" chamber 188 of the fluid actuator 88. The fifth port 504 is for supplying fluid to and receiving fluid from the "open" chamber 184 of the fluid actuator 88. The distance D1 between the two second obturating surfaces 448 and the distance D2 between the two annular second valve seats 462 are such that the pistons 426, 428 permit limited fluid flow or a "controlled leakage" from the first port 482 equally to the fourth port 502 and fifth port 504 when the valve stem 446 is in the "neutral" or first position. The distances D1 and D2 are also such that the pistons 426, 428 allow preferential fluid flow through the fourth port 502 or the fifth port 504 and only one of the second port 484 and the third port 486 when the valve stem 446 is in a position other than the first position. It should be apparent that the distances D1 and D2 may be established so that the pistons 426, 428 completely block fluid flow to the fourth port 502 and the fifth port 504 when the valve stem 446 is in the first position.

Operation

The description will relate to the shears 20 and blades 22,24 but is equally applicable to the use of the shears 20B, modified frame 62B and blades 22B, 24B, and any other of the blades or work members operable by the disclosed mechanism. To operate the shears 20 embodying the present invention the following procedure is followed. Assuming that the operator desires to cut something, such as cloth, paper, cardboard or meat, the shears 20 will normally start with the blades 22, 24 in the fully open relative position illustrated in FIG. 2. To move the blades 22, 24 from the open position illustrated in FIG. 2 to the closed ending position illustrated in FIG. 1, the operator first inserts a thumb into the thumb opening 142 in the thumb handle portion 64 in the frame 62. As the operator's thumb is fitted in the opening 64, the safety button 206 if provided, is depressed to permit pressurized fluid to pass through the safety valve 86 and into the servo control valve 84. In the preferred embodiment, the button, safety lever 202 and safety valve 86 are omitted and pressurized fluid passes directly to the control valve 84. At least one of the operator's fingers is received in the finger handle portion 322 in the finger loop handle 66. The operator then manually pivots the finger loop handle 66 from the open position illustrated in FIG. 2 towards the closed position illustrated in FIG. 1. The operator may stop the pivoting movement of the finger loop handle 66 anywhere between the open and closed position or continue to the travel limit or closed position, illustrated in FIG. 1.

This starting of relative pivoting action of the finger loop handle 66 forces the difference link 362 to pivot about the pin 344 in a clockwise direction (FIG. 14) and forces the actuator link 382 to move the stem 400 axially inward of the servo control valve 84 from the position illustrated in FIG. 17A to the position illustrated in FIG. 17B. This motion of the stem 400 allows fluid to flow to "cut" chamber 188 of the actuator 88 through port 502 which moves the piston 168 in a direction to move the rod 166 axially outward of the actuator. That is, the conical surface 448 disengages from the valve seat 442 on piston 426 to communicate the first port 482 with the fourth port 502 to allow fluid flow to the "cut" chamber 188. Concurrently, the left port 504 fluidly communicates with the third port 486 to exhaust fluid from the "open" chamber 184. The second port 484 is maintained blocked by pistion 426. Thus the drive link 102 pivots counterclockwise about the pin 134 and drives the pivotable blade 22 towards the fixed blade 24.

Upon further pivoting movement of the finger loop handle 66 relative to the frame 62, but before the blade 24 catches up to the position indicated by the finger loop handle, the difference link 362 pivots further about the pin 344 in a clockwise direction. This causes the stem 400 to be moved farther inward of the servo control valve 84 from the position illustrated in FIG. 17B to the position illustrated in FIG. 17C. The conical surface 448 is spaced further from the valve seat 442 on piston 426 and the piston 428 is spaced further from annular valve seat 462, than the position illustrated in FIG. 17B. This allows relatively more fluid flow between the first port 482 and the fourth port 502 and between the fifth port 504 and third port 486. The greater fluid flow to the cut chamber 188 of the actuator 88 forces the piston 168 and rod 166 to pivot the blade 22 even faster towards the closed position.

The maximum cut position of the servo control valve 84 is illustrated in FIG. 17D. This position is reached by pivoting the finger loop handle 66 quickly towards the frame 62 while cutting a tough object. The difference link 362 pivots clockwise about the pin 344 to move the stem 400 to its axial inward limit. The conical surface 448 is spaced a maximum distance from the seat 442 of the piston 426 and the piston is held against the annular valve seat 462 by fluid pressure in the chamber 424. Concurrently, the surface 444 of the piston 428 is spaced from the annular vale seat 462. This position permits the maximum fluid flow between the first port 482 and the fourth port 502 and between the fifth port 504 and third port 486. This flow moves the blade 22 quickly and with maximum force, to cut the tough object.

When the pivoted position of the blade 22 begins to catch up with the position indicated by the finger loop handle 66, the difference link 362 begins to pivot about the pin 366 due to movement of the pivotable blade relative to the position of the finger loop handle. The difference link 362 causes the stem 400 to move axially outward of the servo control valve 84 to the position illustrated in FIG. 17E from the position illustrated in FIGS. 17C or 17D. The conical surface 448 moves closer to the piston 426 and the piston 428 moves closer to the valve seat 462. Fluid flow from the first port 482 to the fourth port 502 and from the fifth port 504 to third port 486 continues but at a reduced rate. The blade 22 still is forced to close but at a slower closure rate.

The cutting action of the blades 22, 24 can be stopped at any time by stopping the finger loop handle 66 at any position between its travel limits. The blade 22 will then stop at a position corresponding to the relative position of the finger loop handle 66. This will cause the difference link 362 to maintain a neutral position in which fluid pressure, applied to either chamber 184, 188 of the actuator 88, is not increased.

To open the shears 20 from the position illustrated in FIG. 1 towards the position illustrated in FIG. 2, the operator manually pivots the loop handle 66 away from the frame 62. The difference link 362 pivots counterclockwise about the pin 344 to force the actuator link 386 to pull the stem 400 outwardly of servo control valve 84. This action provides fluid flow from the control valve to the open chamber 184 in the actuator 88. Fluid pressure in chamber 184 forces the power rod 166 to move axially inward into the actuator 88 and causes the drive link 102 to pivot clockwise about the pin 134. This imparts a force to pivot the blade 22 counterclockwise about the axis AA in a direction towards the open position relative to the fixed blade 24.

When the difference link 362 pivots counterclockwise about the pin 344, the stem 400 is caused to move axially outward of the servo control valve 84 from the position illustrated in FIG. 17E to the position illustrated in FIG. 17F. The right conical surface 448 engages the piston 426 to block fluid flow to the "cut" chamber 188 through the fourth port 502. The second port 484 remains blocked by the piston 426. The left conical surface 448 disengages the piston 428 to allow fluid flow to the "open" chamber 184 through the fifth port 504. The third port 486 is closed by the piston 428. Pressure in the chambers 184 and 188 equalizes on either side of the piston 168 to stop movement of the rod 166 and blade 22.

The difference link 362 and stem 400 are returned to their respective neutral positions. The stem 400 is centered in the servo control valve 84 in the first position again, as illustrated in FIG. 17G which is the same as FIG. 17A. Equal fluid flow, or no fluid flow, occurs from the first port 482 to the fourth port 502 and fifth port 504. Exhaust to the second and third ports 484, 486 is permitted if needed.

If the blade 22, during a cutting action, overshoots the desired position indicated by the finger loop handle 66, the servo control valve 84 can compensate, as illustrated in FIG. 17H. The difference link 362 pivots clockwise about the pin 366 due to the excessive movement of the blade 22. The stem 400 is moved axially outward of the servo control valve 84 to the position illustrated in FIG. 17H. The piston 426 is spaced from the annular valve seat 462 to permit fluid flow from the "cut" chamber 188 through the fourth port 502 to exhaust through the second port 484. The piston 426 engages conical surface 448 to block fluid flow from the first port 482. At the same time, the piston 428 engages the annular valve seat 462 but is spaced from the left conical surface 448. This blocks fluid flow to exhaust through the third port 486 while permitting fluid flow from the inlet first port 482 to the open chamber 184 through the fifth port 504. This flow causes the piston 168 and rod 166 to move inward of the actuator 88 to stop and reverse the cutting action of the pivotable blade 22.

Other uses than the power operated shears are also contemplated for the tool of the present invention. For example, the tool can be used, without limitation, as power operated pliers, crimpers, clamp, caulking gun or other tool in which it is desirable to have reversible, controllable, force multiplied and/or slower speed at the end of relative movement between members.

Thus, while preferred embodiments of the invention have been disclosed, various modifications and alterations can be made thereto without departing from the spirit and scope of the invention set forth in the appended claims.

We claim:

1. A pair of replaceable scissors blades without handles, secured together with a pivot structure for attachment and removal as a unit with respect to a support and a blade actuator, comprising:

a first blade with a cutting portion, a mounting portion and a first pivot-receiving aperture in the mounting portion, a second blade with a cutting portion, an actuating portion and a second pivot-receiving aperture between the two portions of the second blade, a pivot structure connecting the first and second blades through said pivot-receiving apertures, said pivot structure having a first element that is wider than said first pivot-receiving aperture and engages an outer surface of said first blade and has a clamping surface facing away from said first blade, said pivot structure having a second element that is wider than said second pivot-receiving aperture and engages an outer surface of said second blade, said elements being interconnected, such that said first and second blades are secured together by said pivot structure for relative pivoting about the pivot structure independently of any support structure and independently of any actuating structure, said pivot structure defining an aperture extending through said first and second elements and being surrounded by the clamping surface and through which said blades may be secured to a support by way of the pivot structure, said actuating portion of the second blade having a slot extending at an obtuse angle with respect to a general extent of the cutting portion of the second blade, and said mounting portion of the first blade having two locating apertures at approximately diametrically opposed locations relative to the first pivot-receiving aperture and spaced from each other in a direction transverse to a general extent of the first blade and a distance greater than the maximum width of the cutting portion of the first blade.

2. A pair of replaceable scissors blades without handles as set forth in claim 1, wherein the mounting portion of the first blade is of a size and shape that completely overlaps the actuating portion of the second blade only when the blades are closed.

3. A pair of replaceable scissors blades without handles as set forth in claim 2, wherein the actuating portion of the second blade has a crescent-shaped portion extending in a direction transverse to the general extent of the cutting portion of the second blade.

4. A pair of replaceable scissors blades without handles as set forth in claim 1, wherein the pivot structure has a central axis that extends through said first pivot-receiving aperture of the first blade at a location that is slightly offset to one side of a straight line extending between said locating apertures of said first blade.

5. A pair of replaceable scissors blades without handles as set forth in claim 1, wherein one of the first and second pivot structure members includes a threaded internal surface bounding a portion of the pivot structure aperture.

6. A pair of replaceable scissors blades without handles as set forth in claim 5, wherein the second pivot structure member includes the threaded internal surface bounding the portion of the pivot structure aperture.

7. A pair of replaceable scissors blades without handles as set forth in claim 6, wherein the first pivot structure member includes a threaded internal surface and the second pivot structure member includes a threaded external surface which engages the threaded internal surface of first pivot structure member.

8. A pair of replaceable working members without handles, secured together with a pivot structure for attachment and removal as a unit with respect to a support and a working member actuator, comprising:

a first working member with a working portion, a mounting portion and a first pivot-receiving aperture in the mounting portion, a second working member with a working portion, an actuating portion and a second pivot-receiving aperture between the two portions of the second working member, a pivot structure connecting the first and second working members through said pivot-receiving apertures, said pivot structure having a first element that is wider than said first pivot-receiving aperture and engages an outer surface of said first working member and has a clamping surface facing away from said first working member, said pivot structure having a second element that is wider than said second pivot-receiving aperture and engages an outer surface of said second working member, said elements being interconnected, such that said first and second working members are secured together by said pivot structure for relative pivoting about the pivot structure independently of any support structure and independently of any actuating structure, said pivot structure defining an aperture extending through said first and second elements and being surrounded by the clamping surface and through which said first and second working members may be secured to a support by way of the pivot structure, said actuating portion of the second working member having a slot extending at an obtuse angle with respect to a general extent of the working portion of the second working member, and said mounting portion of the first working member having two locating apertures at approximately diametrically opposed locations relative to the first pivot-receiving aperture and spaced from each other in a direction transverse to the general extent of the first working member and a distance greater than the maximum width of a working portion of the first working member.

9. A pair of replaceable working members without handles as set forth in claim 8, wherein the actuating portion of the second working member has a crescent-shaped portion extending in a direction transverse to the general extent of the working portion of the second working member.

10. A pair of replaceable working members without handles as set forth in claim 9, wherein the pivot structure has a central axis that extends through said first pivot-receiving aperture of the first working member at a location that is slightly offset to one side of a straight line extending between said locating apertures of said first working member.

11. A pair of replaceable working members without handles as set forth in claim 8, wherein the mounting portion of the first working member is of a size and shape that completely overlaps the actuating portion of the second working member only when the working members are closed.

12. A pair of replaceable working members without handles as set forth in claim 8, wherein one of the first and second pivot structure members includes a threaded internal surface bounding a portion of the pivot structure aperture.

13. A pair of replaceable working members without handles as set forth in claim 12, wherein the second pivot structure member includes the threaded internal surface bounding the portion of the pivot structure aperture.

14. A pair of replaceable working members without handles as set forth in claim 13, wherein the first pivot structure member includes a threaded internal surface and the second pivot structure member includes a threaded external surface which engages the threaded internal surface of first pivot structure member.

* * * * *